US011090552B2

(12) United States Patent
Ludwick

(10) Patent No.: US 11,090,552 B2
(45) Date of Patent: Aug. 17, 2021

(54) LOCK ZONE

(71) Applicant: Video Gaming Technologies, Inc., Franklin, TN (US)

(72) Inventor: John Victor Ludwick, Reno, NV (US)

(73) Assignee: VIDEO GAMING TECHNOLOGIES, INC., Franklin, TN (US)

( * ) Notice: Subject to any disclaimer, the term of this patent is extended or adjusted under 35 U.S.C. 154(b) by 31 days.

(21) Appl. No.: 16/285,552

(22) Filed: Feb. 26, 2019

(65) Prior Publication Data

US 2019/0184268 A1 Jun. 20, 2019

Related U.S. Application Data

(63) Continuation of application No. 15/627,162, filed on Jun. 19, 2017, now Pat. No. 10,258,869.

(51) Int. Cl.

| | |
|---|---|
| ***G07F 17/32*** | (2006.01) |
| ***A63F 3/00*** | (2006.01) |
| ***A63F 11/00*** | (2006.01) |

(52) U.S. Cl.

CPC ..... *A63F 3/00157* (2013.01); *A63F 11/0011* (2013.01); *G07F 17/3213* (2013.01); *G07F 17/3244* (2013.01); *G07F 17/3262* (2013.01); *G07F 17/3267* (2013.01); *A63F 2011/0058* (2013.01)

(58) Field of Classification Search

None

See application file for complete search history.

(56) References Cited

U.S. PATENT DOCUMENTS

| | | | |
|---|---|---|---|
| 6,604,740 | B1 | 8/2003 | Singer |
| D603,416 | S | 11/2009 | Poling |
| 7,666,093 | B2 | 2/2010 | Lafky |
| D677,685 | S | 3/2013 | Simmons |
| D689,066 | S | 9/2013 | Santos |
| 8,727,855 | B2 | 5/2014 | Williams |
| D714,337 | S | 9/2014 | McCormack |

(Continued)

OTHER PUBLICATIONS

New "Walking Dead" Slot (All Features)—DEMO @ G2E & Aristocrat, YouTube video, https://www.youtube.com/watch?v=nc8IFTVXbas, Oct. 6, 2015 (Year: 2015).*

(Continued)

*Primary Examiner* — Damon J Pierce

(74) *Attorney, Agent, or Firm* — McAndrews, Held & Malloy, Ltd.

(57) ABSTRACT

A gaming machine that includes a game controller to select symbols from the memory, cause the display to display the selected symbols at the display positions, determine if the displayed symbols include a predetermined symbol, and if the predetermined symbol lands on the pay line, in response to the predetermined symbol landing on the pay line, 1) cause the display to animate the first plurality of anticipation states on the pay line, and 2) randomly determine whether to transition the predetermined symbol to the second plurality of free spin states, in response to determining the predetermined symbol transitioning to the second plurality of free spin states, cause the display to animate the second plurality of free spin states on the pay line.

20 Claims, 21 Drawing Sheets

(56) References Cited

U.S. PATENT DOCUMENTS

| | | | | |
|---|---|---|---|---|
| D716,828 | S | 11/2014 | Kim | |
| 8,931,003 | B2 | 1/2015 | Kim | |
| D737,279 | S | 8/2015 | Taniuchi | |
| D754,671 | S | 4/2016 | Aldamiz Echevarria | |
| D757,065 | S | 5/2016 | Jeon | |
| D757,769 | S | 5/2016 | Wang | |
| D766,269 | S | 9/2016 | Gandhi | |
| D771,061 | S | 11/2016 | Zhu | |
| D788,133 | S | 5/2017 | Fedorova | |
| D791,802 | S | 7/2017 | Solop | |
| D791,808 | S | 7/2017 | Johnston | |
| D795,899 | S | 8/2017 | Carrigan | |
| D800,765 | S | 10/2017 | Stoksik | |
| 2003/0045343 | A1 | 3/2003 | Luccesi et al. | |
| 2004/0048646 | A1 | 3/2004 | Visocnik | |
| 2008/0108411 | A1* | 5/2008 | Jensen | G07F 17/32 463/20 |
| 2010/0105466 | A1 | 4/2010 | Inamura | |
| 2012/0157181 | A1 | 6/2012 | Jensen et al. | |
| 2013/0143635 | A1* | 6/2013 | Arora | G07F 17/3265 463/20 |
| 2014/0031101 | A1 | 1/2014 | Jaffe et al. | |
| 2014/0164941 | A1 | 6/2014 | Kim | |

OTHER PUBLICATIONS

Walking Dead 2 Slot Machine | Game Play, YouTube video, https://www.youtube.com/watch?v=brzs0_znLII, Jul. 2, 2016 (Year: 2016).*

"Global Slot Machine Market 2017." legmannews.com. Oct. 31, 2017. Accessed Apr. 22, 2018. Available online at URL: <http://legmannews.com/global-slot-machine-market-2017-igt-aristocrat-leisure-scientific-games-novomatic-konami-gaming-ainsworth/>.

Australian Examination Report for App. No. AU2019268106, dated Jan. 6, 2021, 5 pages.

* cited by examiner

LOCK ZONE

RELATED APPLICATIONS

This application is a continuation of U.S. patent application Ser. No. 15/627,162, filed Jun. 19, 2017 and entitled "Lock Zone," which is hereby incorporated by reference herein in its entirety.

FEDERALLY SPONSORED RESEARCH OR DEVELOPMENT

[Not Applicable]

MICROFICHE/COPYRIGHT REFERENCE

[Not Applicable]

BACKGROUND

In electronic gaming machines, stepper video games are often played. While such gaming systems provide players with enjoyment, a need exists for new gaming systems in order to maintain or increase player enjoyment.

BRIEF SUMMARY

One embodiment provides a gaming machine that includes a credit input mechanism to receive a physical item representing a monetary value for establishing a credit balance. The credit balance is increasable and decreasable based at least on wagering activity. The gaming machine also includes credit meters to monitor the credit balance, and a display having a plurality of display positions and displaying a pay line. The gaming machine also includes a memory storing a plurality of symbols including a predetermined symbol. The predetermined symbol has a first plurality of anticipation states and a second plurality of free spin states. The gaming machine also includes a game controller to, in accord with the established credit balance, select symbols from the plurality of symbols stored in the memory, cause the display to display the selected symbols at the display positions, determine whether the selected symbols include a predetermined symbol, and if the predetermined symbol lands on the pay line, in response to the predetermined symbol landing on the pay line, 1) cause the display to animate the predetermined symbol via the first plurality of anticipation states on the pay line, and 2) randomly determine whether to trigger a bonus game, in response to determining the predetermined symbol transitioning to the second plurality of free spin states, cause the display to animate the predetermined symbol via the second plurality of free spin states on the pay line. The gaming machine also includes a payout mechanism to, in response to determining an award is to be provided, increase the credit balance based on the award, and to cause a payout associated with the credit balance.

Another embodiment provides a gaming machine that includes a credit input mechanism to receive a physical item representing a monetary value for establishing a credit balance. The credit balance is increasable and decreasable based at least on wagering activity. The gaming machine also includes credit meters to monitor the credit balance, and a display having a plurality of display positions and displaying a pay line. The gaming machine also includes a memory storing a plurality of symbols including a predetermined symbol, the predetermined symbol having a first plurality of anticipation states, and a second plurality of free spin states. The gaming machine also includes a symbol selection controller to, in accord with the established credit balance, select symbols from the memory. A display controller causes the display to display the selected symbols at the display positions. A trigger condition controller determines if the displayed symbols include a predetermined symbol in a trigger condition. In some cases, the display controller, in response to determining the displayed symbols including a predetermined symbol in a trigger condition, causes the display to animate the first plurality of anticipation states while keeping the predetermined symbol and the trigger condition on the display. A free spin controller randomly determines whether to transition the predetermined symbol to the second plurality of free spin states. In some cases, the display controller, in response to determining that the predetermined symbol is to transition to the second plurality of free spin states, causes the display to animate the second plurality of free spin states while keeping the predetermined symbol and the trigger condition on the display. The gaming machine also includes a payout mechanism to, in response to determining an award is to be provided, increase the credit balance based on the award, and cause a payout associated with the credit balance.

Still another embodiment provides a method of gaming for use with a gaming machine that includes a credit input mechanism to receive a physical item representing a monetary value for establishing a credit balance. The credit balance is increasable and decreasable based at least on wagering activity. The gaming machine also includes credit meters to monitor the credit balance, and a display having a plurality of display positions and displaying a pay line. The gaming machine also includes a memory storing a plurality of symbols including a predetermined symbol. The predetermined symbol has a first plurality of anticipation states, and a second plurality of free spin states. The gaming machine also includes a display having a plurality of display positions and displaying a pay line, a payout mechanism, and a game controller. The method includes selecting, in accord with the established credit balance, a plurality of symbols for display, and displaying the selected symbols in the display positions. The method includes determining if the displayed symbols include a predetermined symbol in a trigger condition, and in response to determining the displayed symbols including a predetermined symbol in a trigger condition, the method includes animating on the display the first plurality of anticipation states while keeping the predetermined symbol and the trigger condition on the display. The method includes randomly determining whether to transition the predetermined symbol to the second plurality of free spin states, and in response to determining that the predetermined symbol is to transition to the second plurality of free spin states, animating on the display the second plurality of free spin states while keeping the predetermined symbol and the trigger condition on the display. The method also includes, in response to determining an award is to be provided, increasing the credit balance based on the award, and causing the payout mechanism to provide a payout associated with the credit balance.

These and other advantages, aspects and novel features of the disclosure, as well as details of an illustrated embodiment thereof, will be more fully understood from the following description and drawings.

BRIEF DESCRIPTION OF THE DRAWINGS

Embodiments of the disclosure will now be described with reference to the accompanying drawings in which.

DETAILED DESCRIPTION

Figure 1:
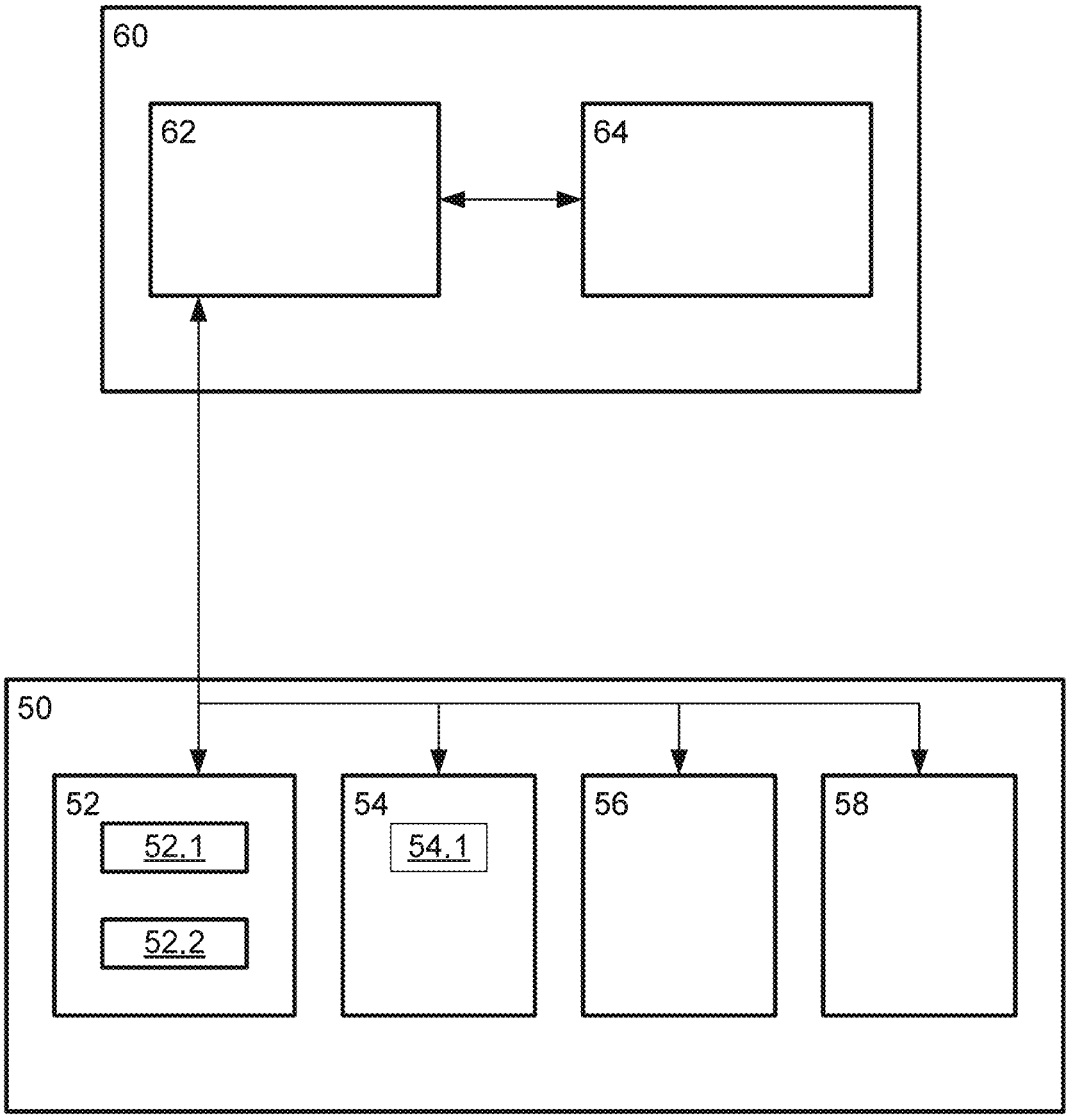
FIG. 1 is a block diagram of the core components of a gaming system.

Referring to the drawings, there is shown an embodiment of a gaming machine that includes a credit input mechanism to receive a physical item representing a monetary value for establishing a credit balance, the credit balance being increasable and decreasable based at least on wagering activity. The gaming machine also includes hardware meters to monitor the credit balance, and a display. The gaming machine also includes a game controller to select symbols from the memory, cause the display to display the selected symbols at the display positions, determine if the displayed symbols include a predetermined symbol, and if the predetermined symbol lands on the pay line, in response to the predetermined symbol landing on the pay line, 1) cause the display to animate the first plurality of anticipation states on the pay line, and 2) randomly determine whether to transition the predetermined symbol to the second plurality of free spin states, in response to determining the predetermined symbol transitioning to the second plurality of free spin states, cause the display to animate the second plurality of free spin states on the pay line.

General Construction of Gaming System

The gaming system can take a number of different forms. In a first form, a standalone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Referring to FIG. 1, the gaming system 1 has several core components. At the broadest level, the core components are a player interface 50 and a game controller 60. The player interface 50 enables manual interaction between a player and gaming system 1, and for this purpose includes input/output components required for the player to enter instructions to play a game and observe game outcomes.

Components of the player interface may vary from embodiment to embodiment but will typically include a credit mechanism 52 to enable a player to input credits. For example, in some embodiments, credit mechanism 52 may include a credit input mechanism 52.1 to receive a physical item representing a monetary value for establishing a credit balance. The credit balance may be increasable and decreasable based on wagering activities. Based on the established credit balance, the gaming system 1 initiates a game. In some embodiments, the credit mechanism 52 also includes a payout mechanism 52.2 to cause a payout associated with the credit balance. The player interface may also include one or more displays 54, a game play mechanism 56 including one or more input devices that enable a player to input game play instructions (e.g. to place a wager), and one or more speakers 58. In some embodiments, each of the displays 54 includes a plurality of display positions. In other embodiments, each of the displays 54 includes a plurality of display areas. Each of the display areas includes a plurality of display positions. In the embodiment shown, the display 54 also includes a credit meter 54.1. In some embodiments, credit meter 54.1 displays credits available, credits bet, and/or credits won.

Game controller 60 is in data communication with player interface 50 and typically includes a processor 62 that processes game play instructions in accordance with game play rules and outputs game play outcomes to the display(s) 54. Typically, the game play rules are stored as program code in a memory 64 but can also be hardwired. In some embodiments, the memory 54 may also store data indicative of a plurality of symbols, pay tables, images, and other information to be used in games. Herein the term "processor" is used to refer generically to any device that can process game play instructions in accordance with game play rules and may include: a microprocessor, microcontroller, programmable logic device or other computational device, a general purpose computer (e.g. a PC) or a server. That is, a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also known to provide a specific purpose processor using an application specific integrated circuit (ASIC) or a field programmable gate array (FPGA).

Figure 2:
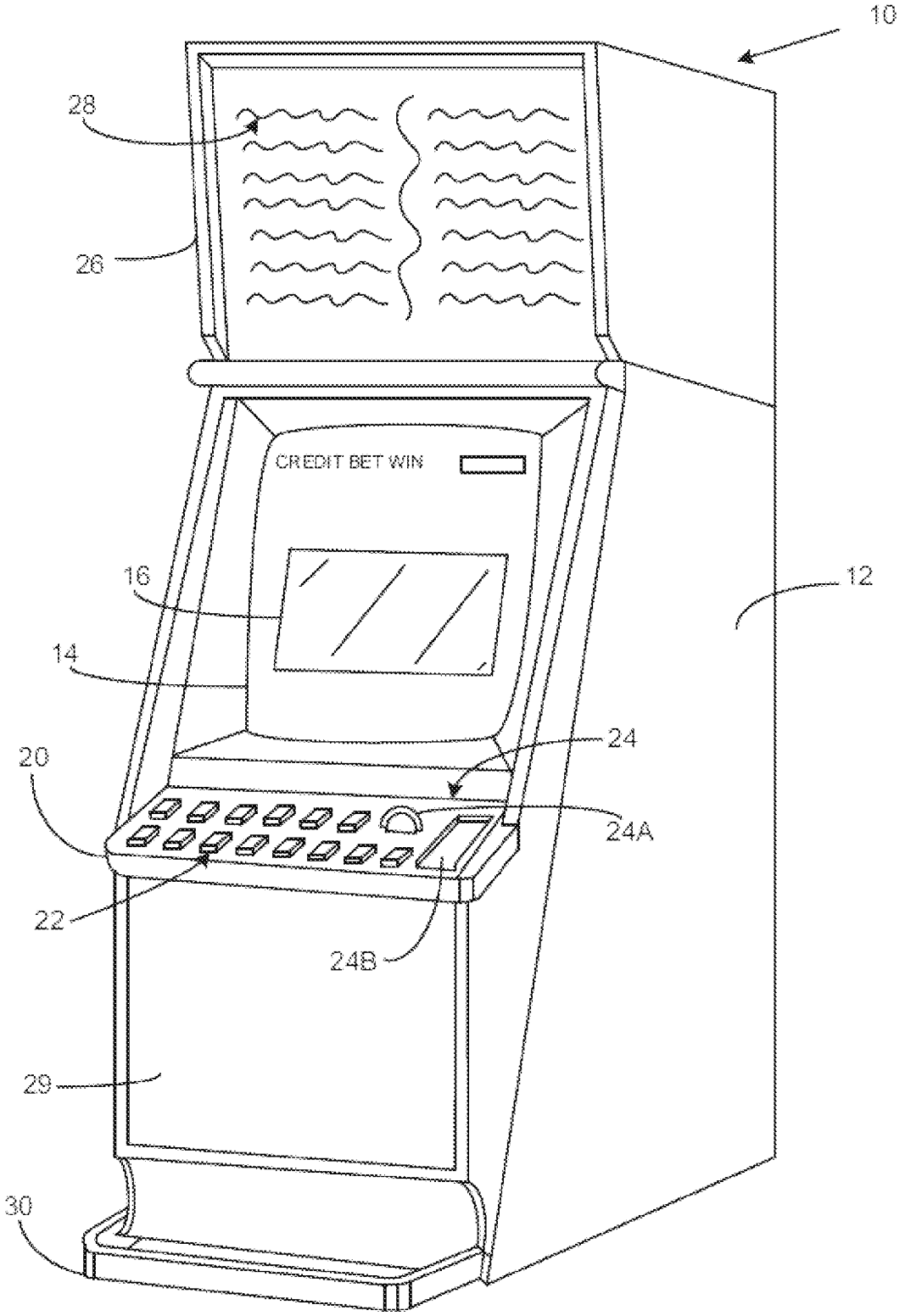
FIG. 2 is a perspective view of a standalone gaming machine.

Referring to FIG. 2, a gaming system in the form of a standalone gaming machine 10 includes a console 12 having a display 14 on which are displayed representations of a game 16 that can be played by a player. Mid-trim 20 of the gaming machine 10 houses a bank of buttons 22 for enabling a player to interact with the gaming machine, in particular during game play. The mid-trim 20 also houses a credit input mechanism 24 (similar to credit input mechanism 52.1 of FIG. 1) which in this example includes a coin input chute 24A and a bill collector 24B. Other credit input mechanisms may also be employed, for example, a card reader for reading a smart card, debit card or credit card. Other gaming machines may be configured to accept a ticket such that the credit input mechanism 24 may have a ticket reader (not shown) for reading tickets having a value and crediting the player based on the face value of the ticket. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

As shown in FIG. 2, a top box 26 may carry artwork 28, including for example pay tables and details of bonus awards and other information or images relating to the game. Further artwork and/or information may be provided on a front panel 29 of the console 12. Gaming machine 10 also includes a payout mechanism in the form of a coin tray 30 that is mounted beneath front panel 29 for dispensing cash payouts from gaming machine 10. Another form of a payout mechanism may include an embedded printer to print out a payout ticket associated with the credit balance that may be redeemed at a cage (not shown).

Display 14 shown in FIG. 2 is in the form of a liquid crystal display. Alternatively, display 14 may be a light emitting diode display, plasma screen, and/or any other suitable video display unit. Top box 26 may also include a display, for example a video display unit, which may be of the same type as display 14, or of a different type.

Figure 3:
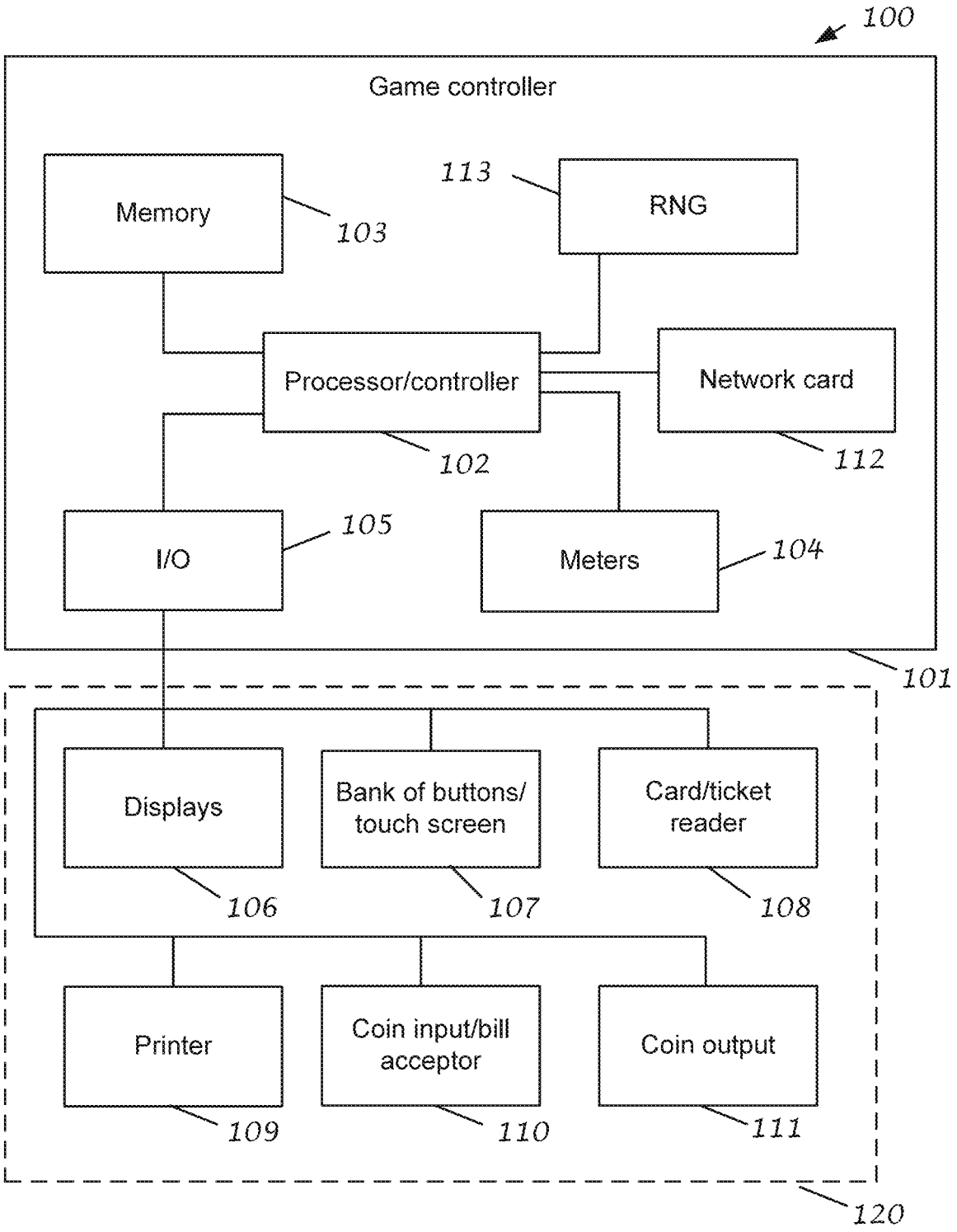
FIG. 3 is a block diagram of the functional components of a gaming machine.

FIG. 3 shows a block diagram of operative components of a typical gaming machine which may be the same as or different to the gaming machine of FIG. 2.

As shown in FIG. 3, a gaming machine 100 includes a game controller 101 having a processor 102 mounted on a circuit board. Instructions and data to control operation of processor 102 are stored in a memory 103, which is in data communication with the processor 102. Typically, gaming machine 100 will include both volatile and non-volatile memory and more than one of each type of memory, with such memories being collectively represented by the memory 103.

Gaming machine 100 has hardware meters 104 for purposes including ensuring regulatory compliance and monitoring player credit, and an input/output (I/O) interface 105 for communicating with peripheral devices of the gaming machine 100. Input/output interface 105 and/or the peripheral devices may be intelligent devices with their own memory for storing associated instructions and data for use with the input/output interface or the peripheral devices. A random number generator module 113 generates random numbers for use by processor 102. Persons skilled in the art will appreciate that the reference to random numbers includes pseudo-random numbers.

In the example shown in FIG. 3, a player interface 120 includes peripheral devices that communicate with game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game, any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, gaming machine 100 may include a communications interface, for example a network card 112. Network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
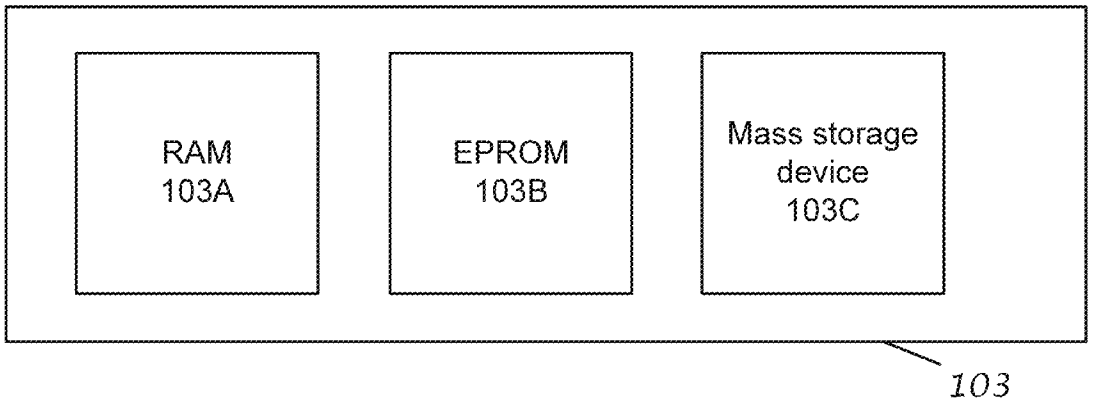
FIG. 4 is a schematic diagram of the functional components of a memory.

Referring now to FIG. 4, the main components of an exemplary memory 103 include RAM 103A, EPROM 103B and a mass storage device 103C. RAM 103A typically temporarily holds program files for execution by processor 102 and related data. EPROM 103B may be a boot ROM device and/or may contain some system or game related code. Mass storage device 103C is typically used to store game programs, the integrity of which may be verified and/or authenticated by the processor 102 using protected code from EPROM 103B or elsewhere.

It is also possible for the operative components of gaming machine 100 to be distributed, for example, input/output devices 106, 107, 108, 109, 110, 111 may be provided remotely from the game controller 101.

Figure 5:
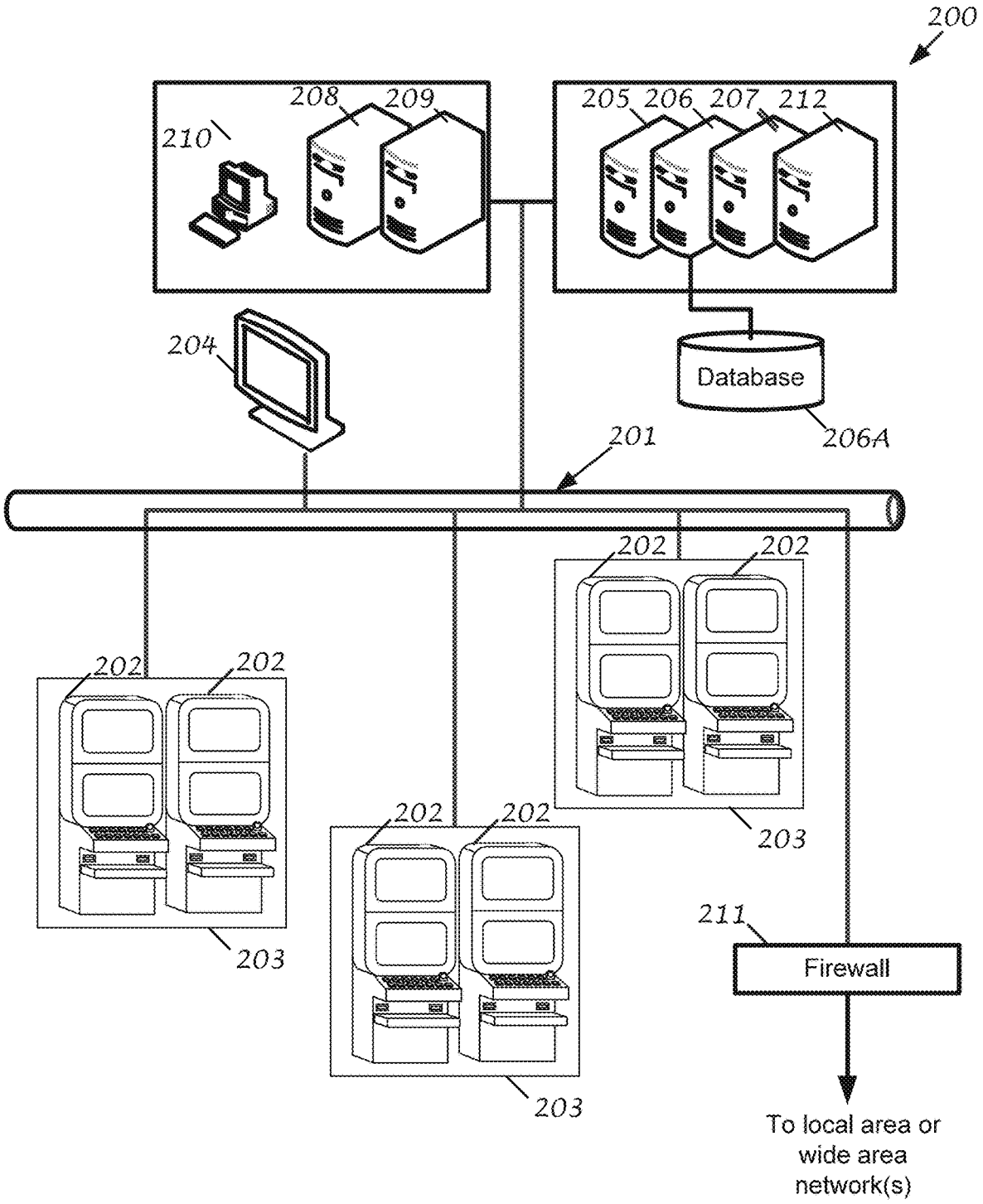
FIG. 5 is a schematic diagram of a network gaming system.

FIG. 5 shows a gaming system 200 in accordance with an alternative embodiment. Gaming system 200 includes a network 201, which for example may be an Ethernet network. Gaming machines 202, shown arranged in three banks 203 of two gaming machines 202 in FIG. 5 are connected to network 201. Gaming machines 202 provide a player operable interface and may be the same as the gaming machines 10, 100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to network 201. For example, displays 204 may be associated with one or more banks 203 of gaming machines. Displays 204 may be used to display representations associated with game play on gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by gaming devices 202 in a database 206A. Typically, if the gaming system enables players to participate in a jackpot game, a jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run network 201 and the devices connected to the network.

Gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, game server 205 could run a random number generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

When the credit input mechanism 52.1 (of FIG. 1) has received a physical item representing a monetary value, a credit balance is established. The player may then operate the game play mechanism 56 (of FIG. 1) to specify one or more of a plurality of wagers for the base game and to initiate a play of the base game. In an exemplary embodiment, at least certain of the wagers that the player can wager entitles the player to win a chance to play a feature game, for example, when a trigger condition occurs. In some embodiments, when the credit input mechanism 52.1 (of FIG. 1) has received a physical item representing a monetary value for establishing a credit balance, at least a portion of the received physical item may initiate a play of the base game directly.

Figure 6:
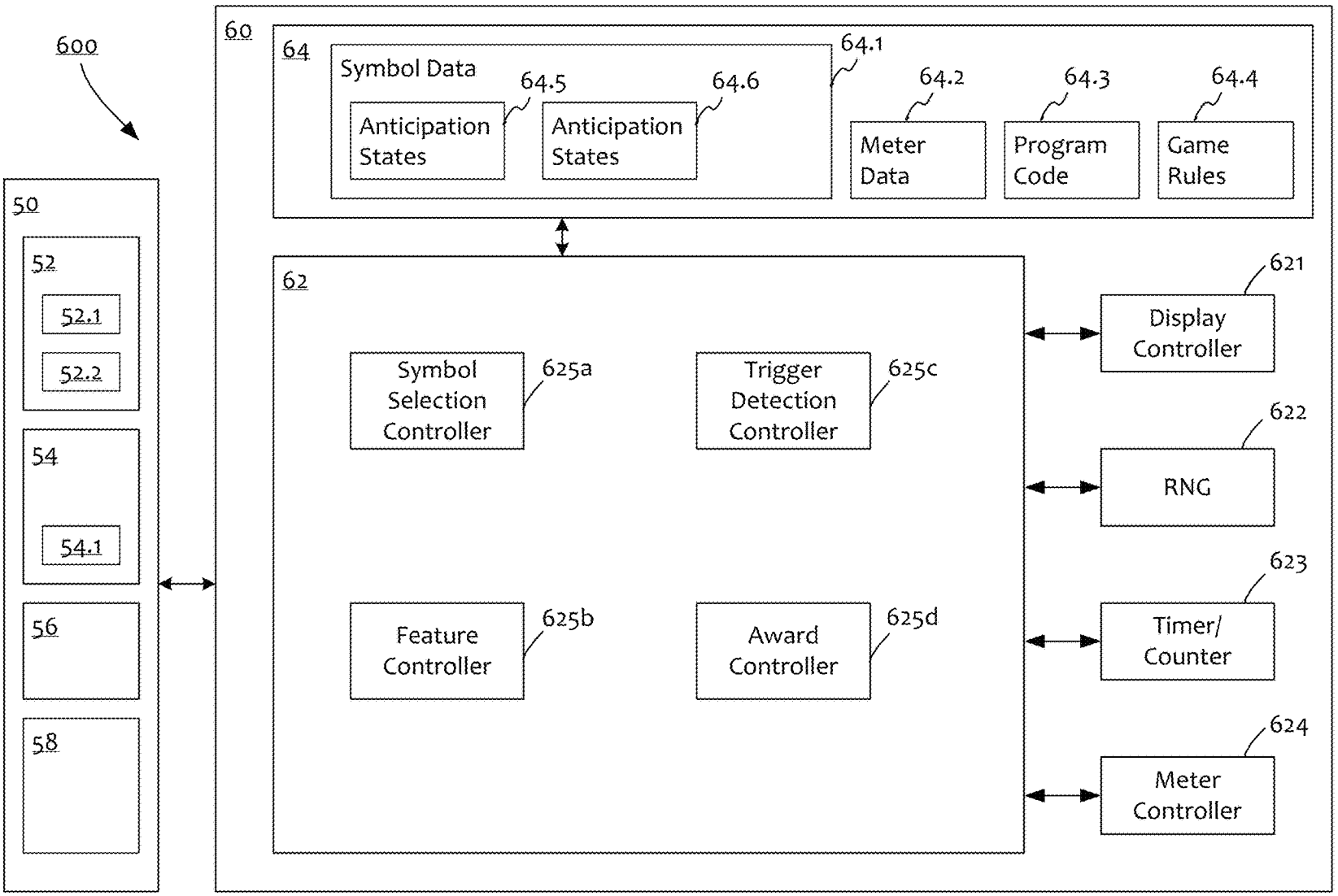
FIG. 6 is a block diagram of a gaming machine.

Referring to FIG. 6, a gaming machine 600 (similar to the gaming machine 10 of FIG. 2) includes a game controller 60. Game controller 60 includes a processor 62 and a memory 64. Memory 64 includes a symbol memory module 64.1 that stores data of a plurality of symbols, a meter memory module 64.2 that stores meter data of gaming machine 600, and a program code memory 64.3 that stores program code to implement a number of modules to be executed by processor 62. In the embodiment, memory 64 also includes a game rule memory module 64.4 that stores a plurality of game rules.

Persons skilled in the art will appreciate that some or all of the components of the game controller 60 could be alternatively implemented. For example, in some embodiments, the game controller 60 and its components are implemented in the form of a dedicated circuit, or an individual application-specific-integrated-circuit (ASIC). In other embodiments, game controller 60 and its components is implemented as an individual ASIC. In other embodiments, some or all of the game controller components may be individually or collectively implemented as software modules, controllers, and/or circuitries.

In the embodiment, game controller 60 includes a display controller 621 which is configured to control display 54, a random number generator (RNG) 622 configured to generate a random number, and a timer/counter 623 configured to time and/or count an amount of time and/or a number of games that a base game has been played, for example, without a win, an upgrade, and/or a trigger event. The timer/counter 623 may also count a number of free spins in a feature game. Game controller 60 also includes an optional meter controller 624 configured to generate meter data, for example, for display or storage based on game play, and/or to read meter data from the meter memory 64.2.

Referring back to FIG. 6, the symbol memory module 64.1 further includes data for a plurality of anticipation states 64.5 of a predetermined symbol to be used in a base game, and data for a plurality of free spin states 64.6 of the predetermined symbol to be used a feature game. An exemplary feature game is a plurality of free re-spins of the base game.

Figure 7A:
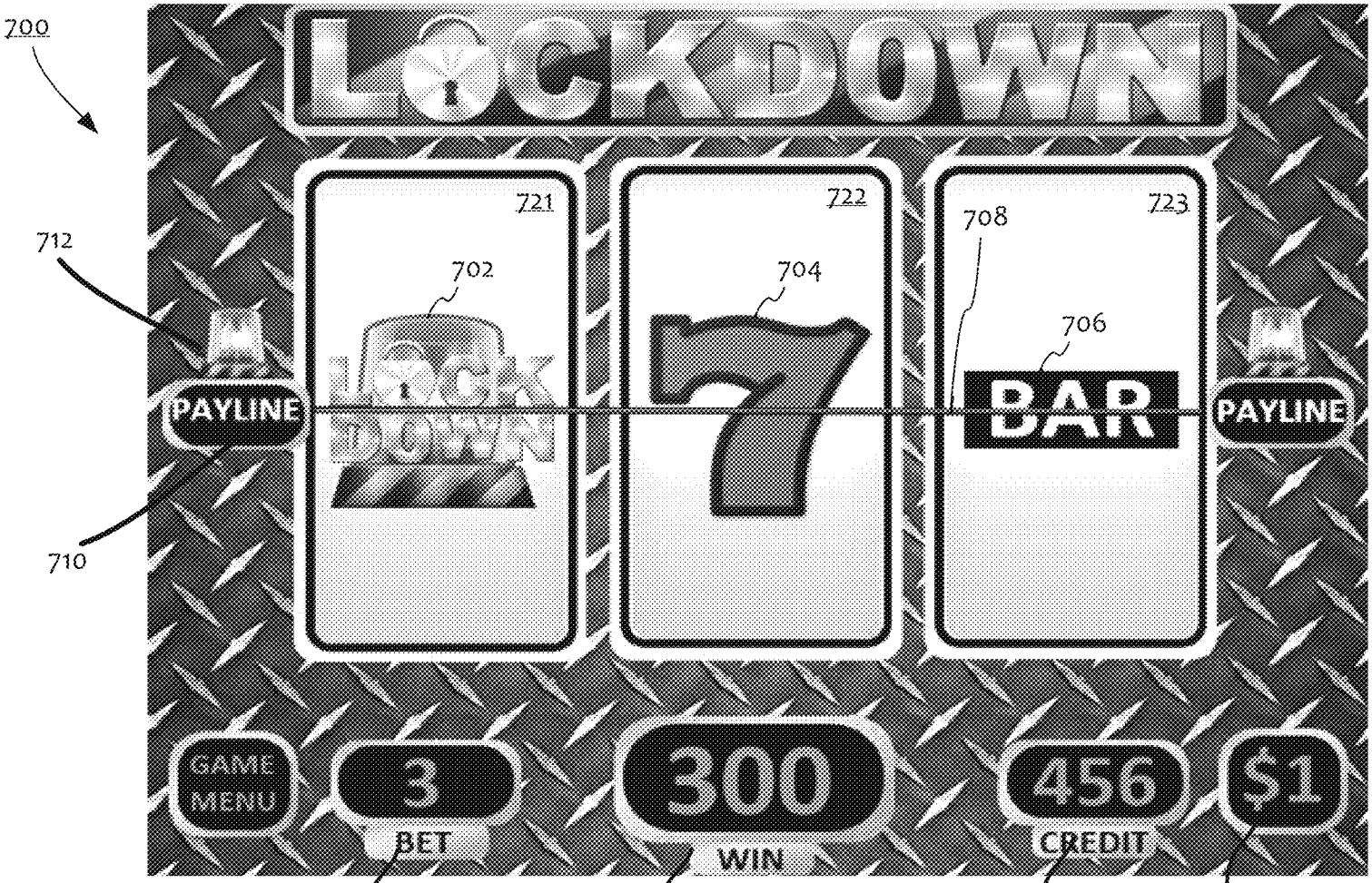
FIG. 7A illustrates an exemplary base game.

FIG. 7A illustrates a first exemplary base game 700 that presents a predetermined symbol 702, and symbols 704, 706 landed on a pay line 708. The base game 700 also shows a pay line text indicator 710 and a siren indicator 712. The base game 700 also shows a number of credit meters, including a bet meter 714, a win meter 716, and a credit meter 718, and a denomination value 720. As shown, the base game 700 includes three spinning reels, 721, 722, 723, and one pay line 708. Each of the spinning reels 721, 722, 723 displays one symbol on the one pay line 708. In other embodiments, however, other numbers of spinning reels and pay lines may be used. In addition, spinning reels 721, 722, 723 may display no symbol on pay line 708, where selected symbols may fall above or below pay line 708 although the selected symbols may be partially or fully seen above or below the pay line 708.

Figure 7B:
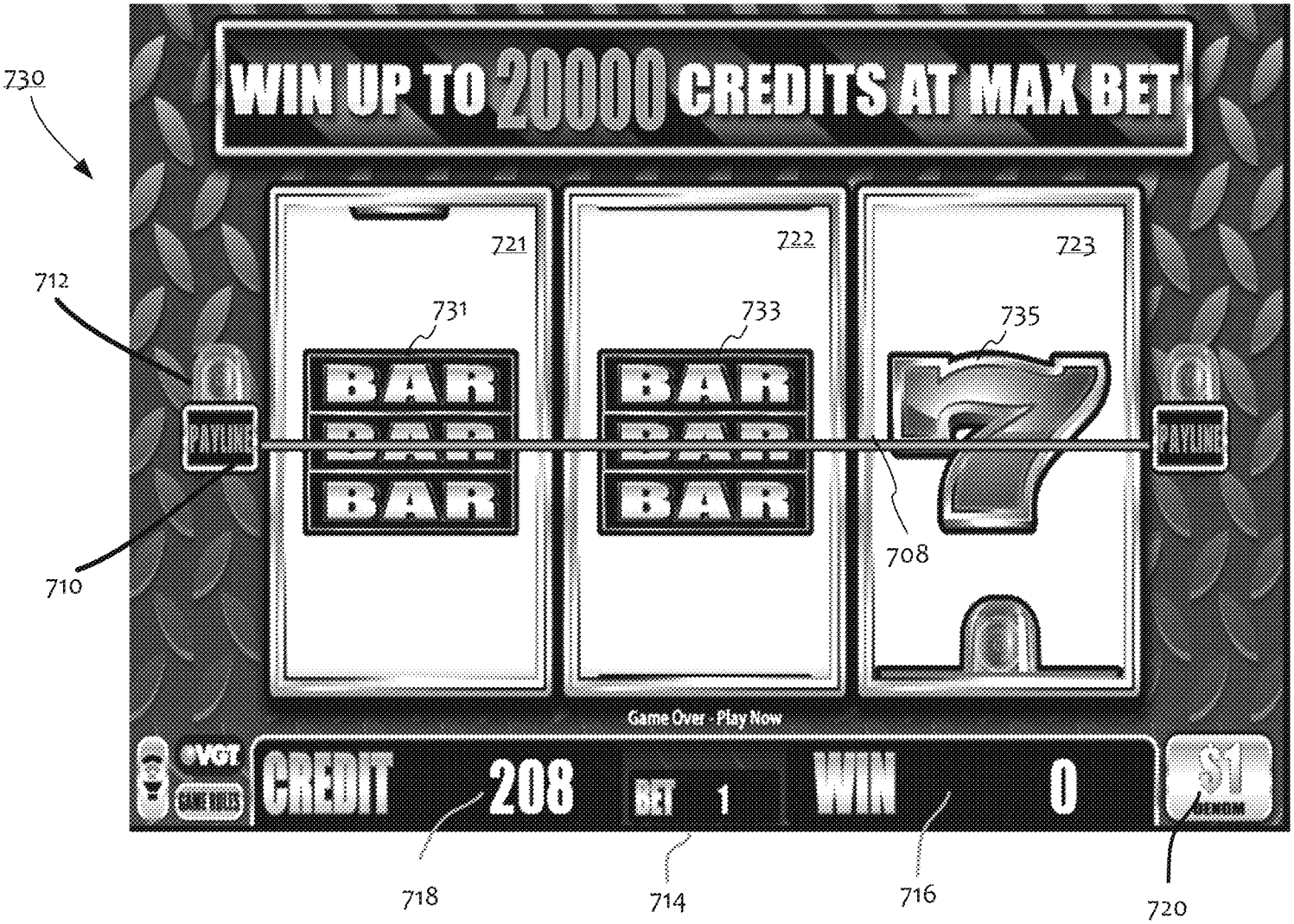
FIG. 7B illustrates a second exemplary base game.

FIG. 7B illustrates a second exemplary base game 730 that presents a plurality of symbols 731, 733, 735 landed on pay line 708 in reels, 721, 722, 723, respectively. In this embodiment, the displayed symbols 731, 733, 735 do not form any winning combination. As such, the pay line text indicator 710 and the siren indicator 712 are not actuated. Like the base game 700 of FIG. 7A, the second exemplary base game 730 also shows bet meter 714, win meter 716, credit meter 718, and denomination value 720.

Figure 7C:
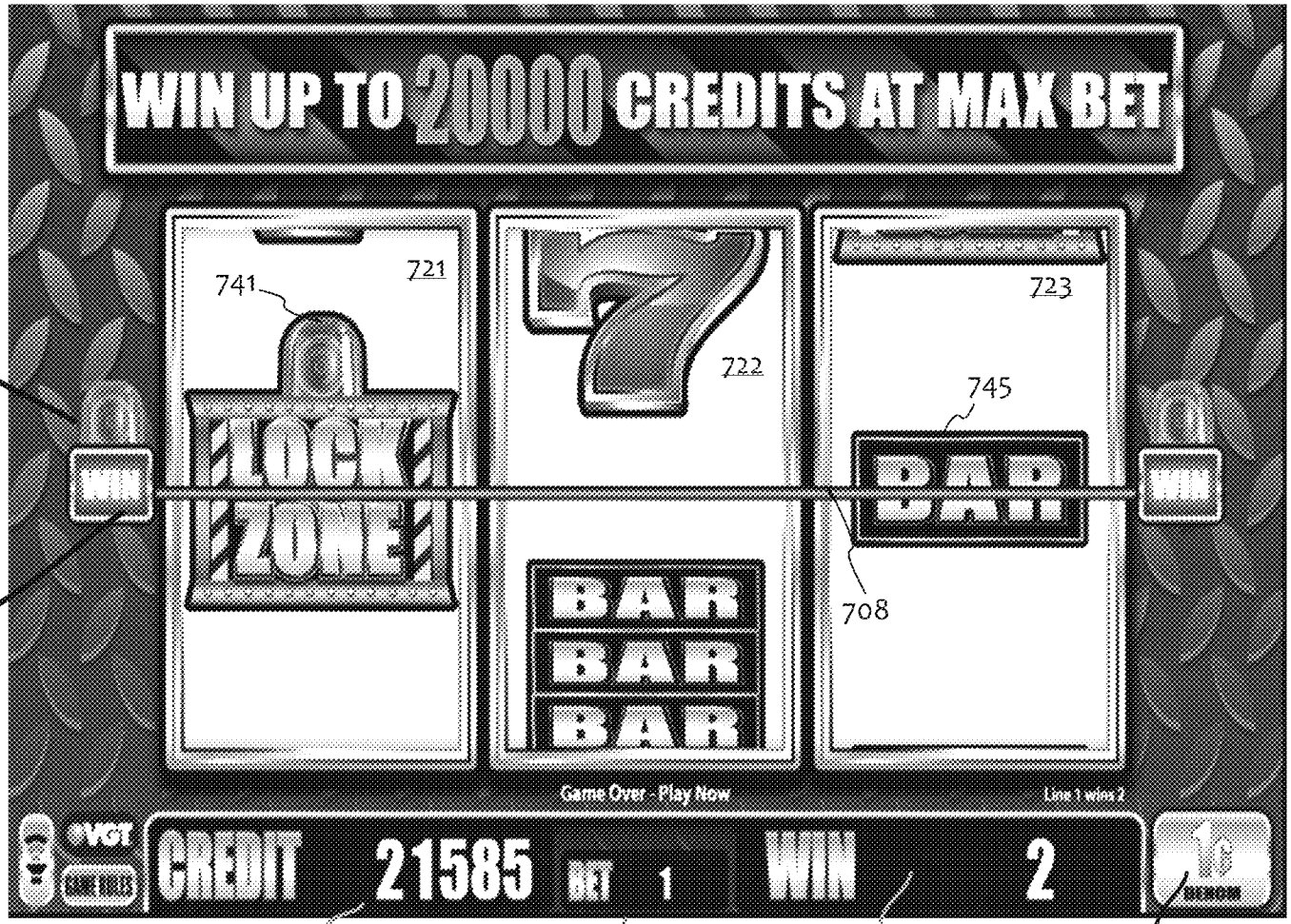
FIG. 7C illustrates a third exemplary base game.
Figure 7D:
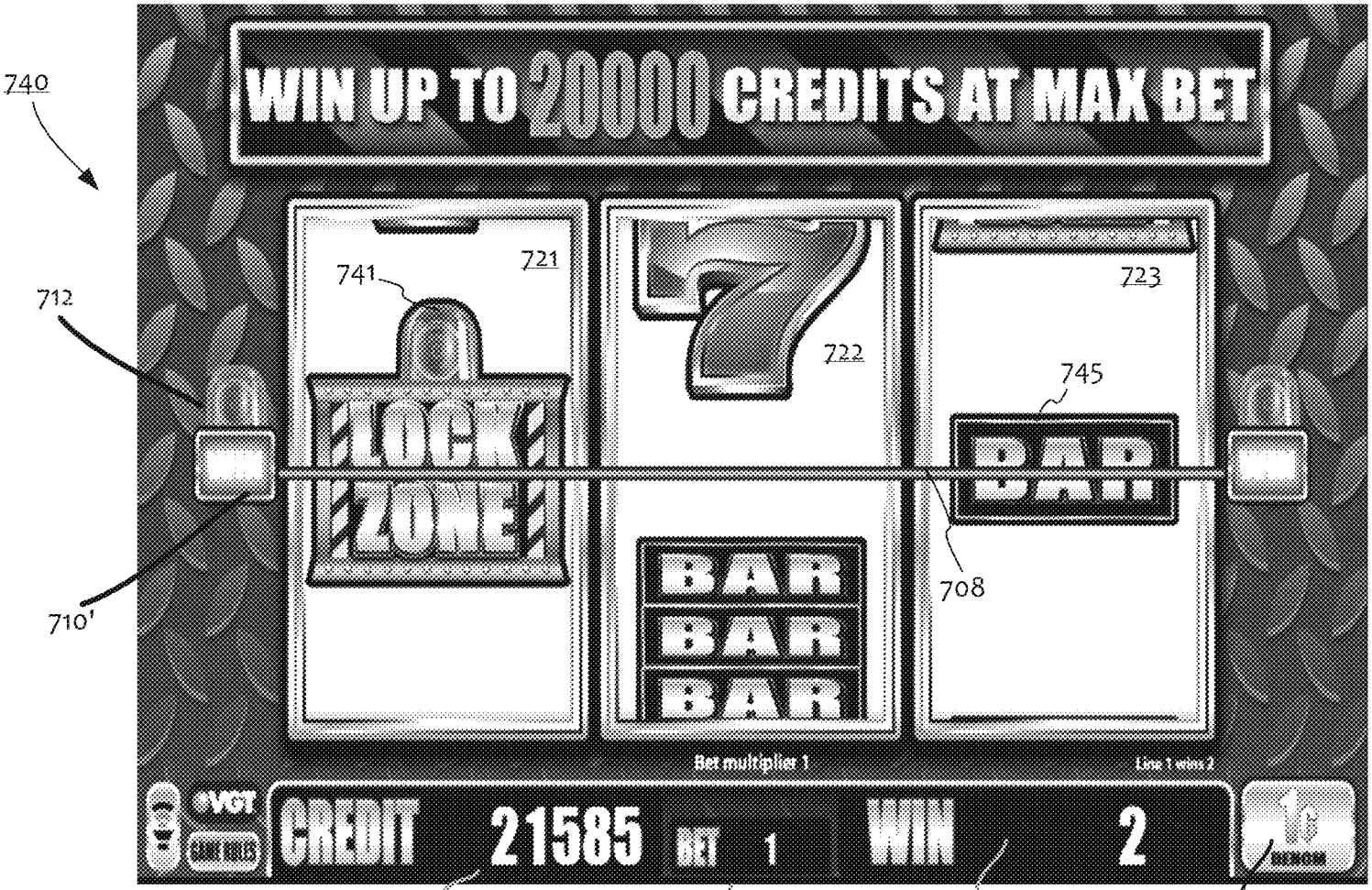
FIG. 7D illustrates a continuation of the third exemplary base game of FIG. 7C.

FIG. 7C illustrates a third exemplary base game 740 that presents predetermined symbol 741 and a one-bar symbol 745 landed on pay line 708 in reels 721, 723, respectively. In this embodiment, the displayed predetermined symbol 741 and the displayed one-bar symbol 745 form a winning combination. As such, the pay line text indicator 710 indicates a "WIN" condition, but the siren indicator 712 is not actuated because the predetermined symbol 741 does not transition into a feature game. FIG. 7D illustrates a continuation of the third exemplary base game 740 in which the "WIN" condition of the pay line text indicator 710 begins to glow.

Figure 7E:
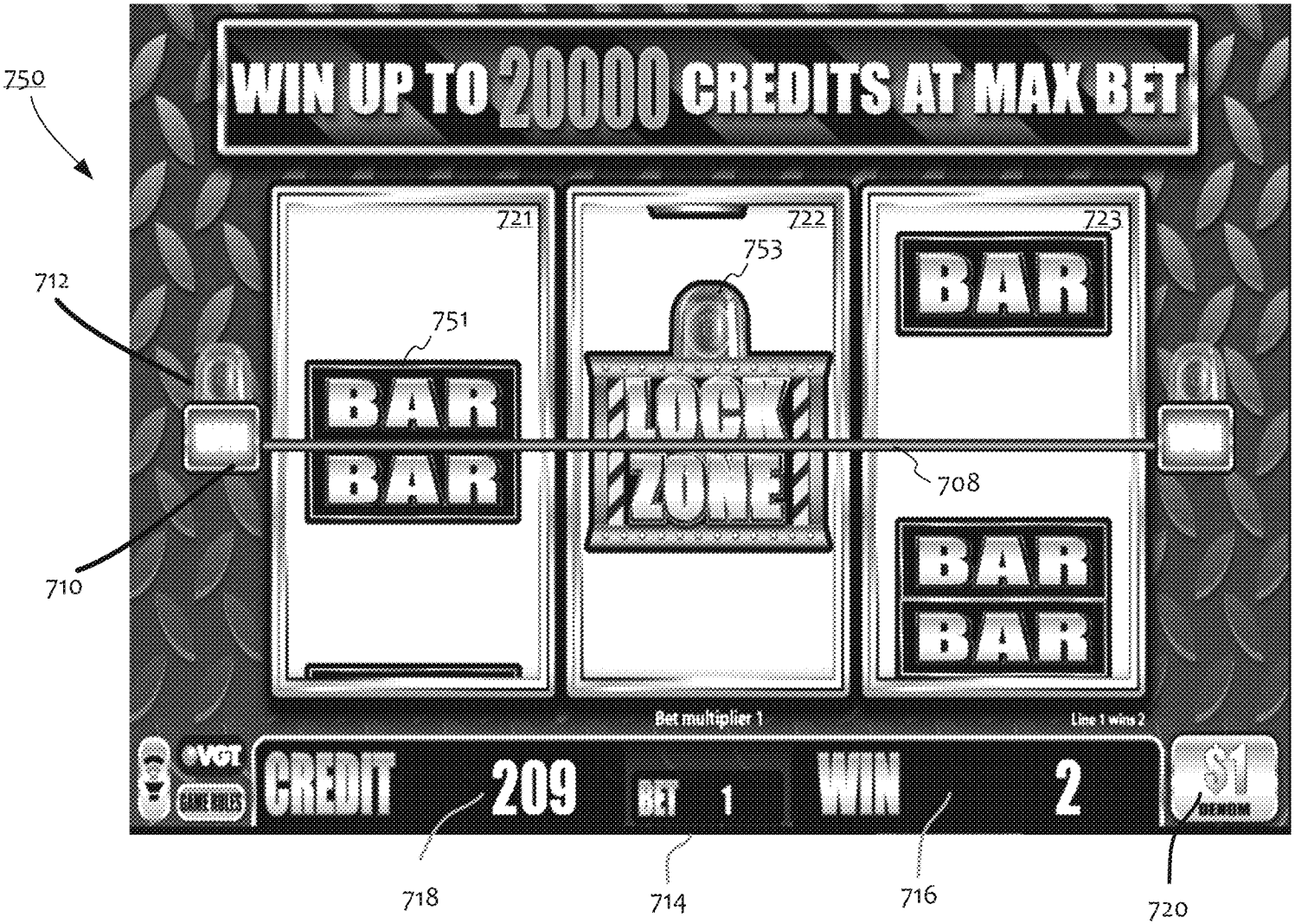
FIG. 7E illustrates a fourth exemplary base game.

FIG. 7E illustrates a fourth exemplary base game 750 that presents a two-bar symbol 751 and a predetermined symbol 753 landed on pay line 708 in reels 721 and 722, respectively. In this embodiment, the displayed symbols 751, 753 form a winning combination. As such, the pay line text indicator 710 indicates a "WIN" condition, but the siren indicator 712 is not actuated because the predetermined symbol 741 does not transition into a feature game.

Figure 8A:
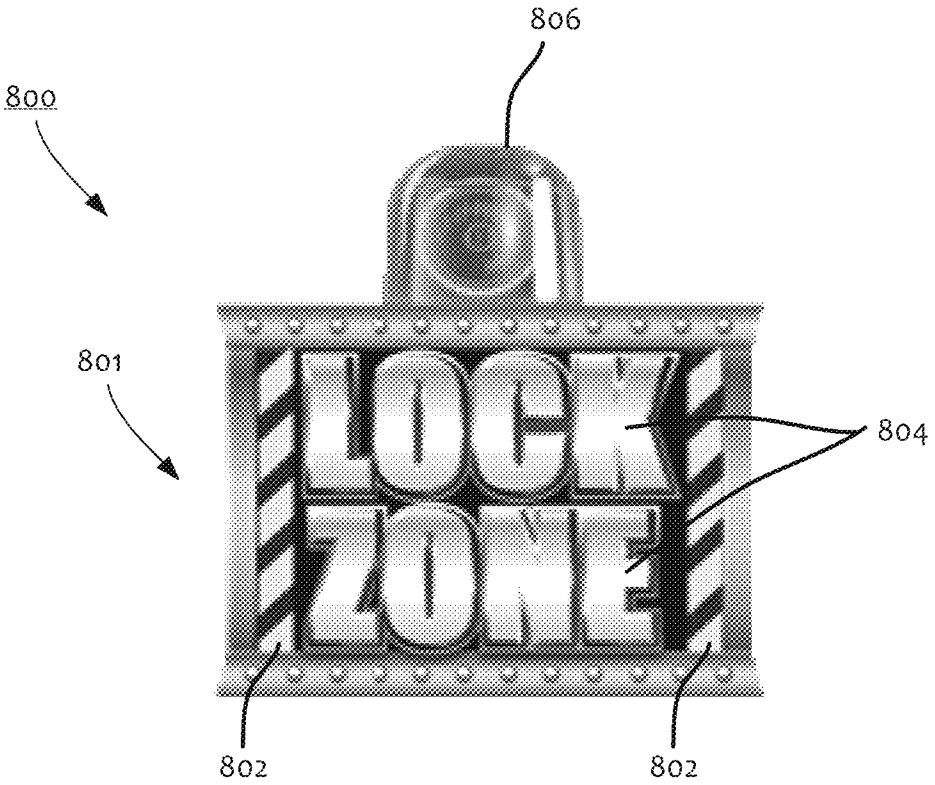
FIG. 8A illustrates an exemplary predetermined symbol.

Referring now to FIG. 8A, which illustrates an exemplary predetermined symbol 800 (similar to the predetermined symbol 741 of FIG. 7C) in a first anticipation state 801 of the base game 700 (of FIG. 7C). In some embodiments, the predetermined symbol 800 is also a wild symbol. The predetermined symbol 800 includes a plurality of doors 802, symbol text 804, and a siren 806. During the base game 700 (of FIG. 7C), the doors 802 open or partially close, and sandwich the symbol text 804, and the siren 806 flashes or turns off, as discussed above, and hereinafter.

Figure 8B:
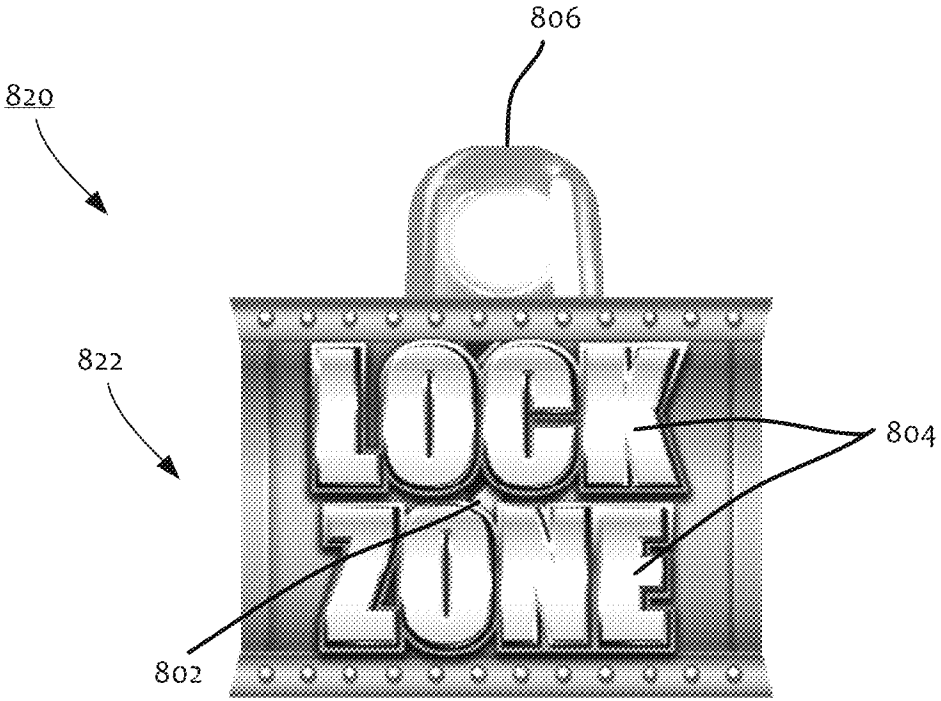
FIG. 8B illustrates an exemplary predetermined symbol in a first lock down state.
Figure 8C:
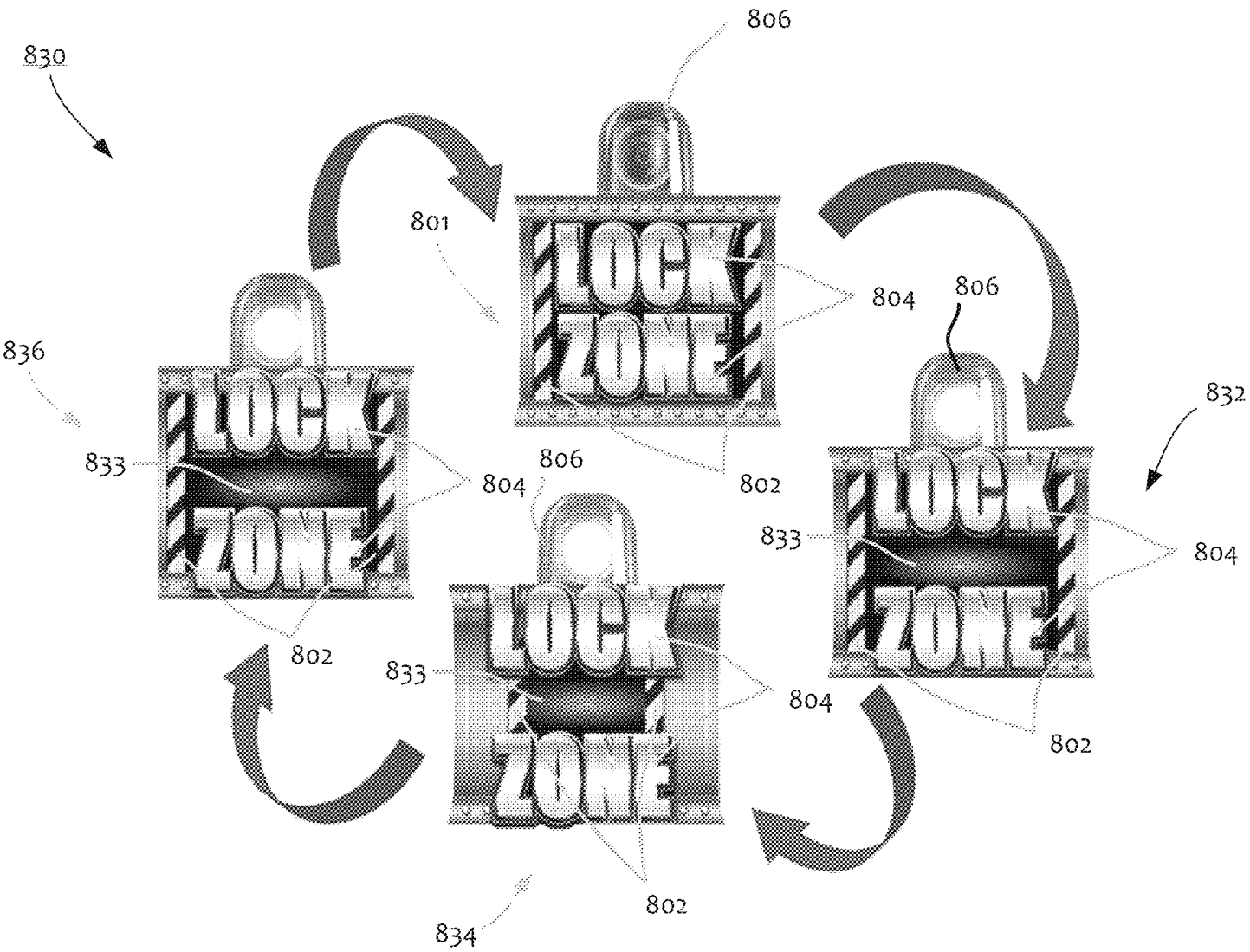
FIG. 8C illustrates an exemplary predetermined symbol within a plurality of anticipation states.
Figure 8D:
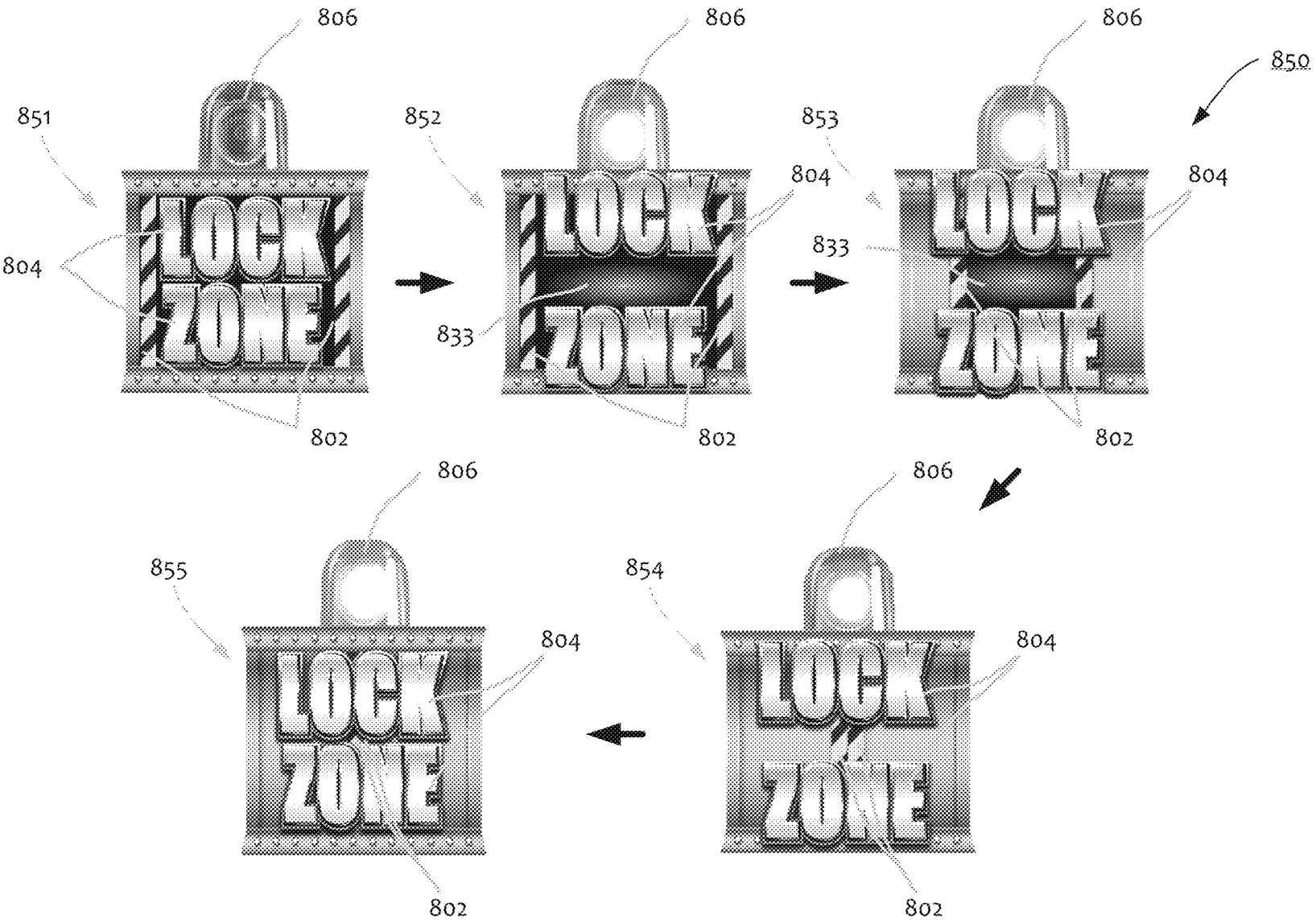
FIG. 8D illustrates an exemplary predetermined symbol within a plurality of free-spin states.

FIG. 8B illustrates an exemplary predetermined symbol 820 in a free-spin state 822 during play of a feature game, or a plurality of free-spin games (of FIG. 8D). When a feature game is initiated, display controller 621 animates the predetermined symbol 820 on the display 54 as described below. For example, display controller 621 may animates that the doors 802 are closed behind the symbol text 804, and the siren 806 is lit.

In some embodiments, the predetermined symbol 800 has a plurality of anticipation states 830 as shown in FIG. 8C. The anticipation states 830 include the first anticipation state 801, as discussed above, with respect to FIG. 8A. The anticipation states 830 also show a second anticipation state 832. When the predetermined symbol 800 lands on a pay line, the predetermined symbol 800 enters the second anticipation state 832, in which the symbol text 804 ("Lock Zone") begins to separate, the siren 806 lights up, and a glow 833 begins to show in between the symbol text 804. The anticipation states 830 also show a third anticipation state 834. In the third anticipation state 834, the symbol text 804 remains separated, the siren 806 continues to light, the glow 833 continues to show in between the symbol text 804, and the doors 802 begin to partially close. In a fourth anticipation state 836, the symbol text 804 remains separated, the siren 806 continues to light, the glow 833 continues to show in between the symbol text 804, but the doors 802 begin to return to be open. Thereafter, the predetermined symbol 800 returns the first anticipation state 801.

In other words, during play of the base game 700 (of FIG. 7), when the predetermined symbol 800 is displayed, or when the predetermined symbol 800 lands on a pay line, the display 54 animates the predetermined symbol 800 in the anticipation states 830 sequentially. Thus, when a player sees the predetermined symbol 800, the player also sees the doors 802 opening and partially closing, the symbol text 804 separating and rejoining, the glow 833 appearing and disappearing, and the siren 806 flashing and turning off. In some embodiments, the display 54 repeatedly animates the anticipation states 830 in a predetermined amount of time, until a subsequent play of the base game 700 commences, or when an amount of credits have been added to the win meter 716 (of FIG. 7A). Further, in some of embodiments, the display 54 may present the anticipation states 830 as a series of continuous actions depicting movements of the doors 802 and the symbol text 804, appearances of the glow 833, and actuations of the siren 806. However, in other embodiments, the display 54 may present the anticipation states 830 as a series of discrete pictures of movements of the doors 802 and the symbol text 804, appearances of the glow 833, and actuations of the siren 806.

Referring back to FIG. 6, a symbol selection controller 625*a* selects a plurality of symbols from the symbol data memory module 64.1 for display in the base game 700. The processor 62 also includes a feature controller 625*b* to determine whether to award a feature game. In some embodiments, the feature award controller 625*b* randomly determines whether to award a feature game. In other embodiments, the feature controller 625*b* determines whether to award a feature game based on other criteria, such as, for example, wagers placed.

Referring back to FIG. 6, processor 62 also includes a trigger detection controller 625*c* to detect or determine if a trigger condition exists or occurs, and whether a feature game is awarded by the feature controller 625*b*. A trigger condition exists, for example, when the displayed symbols include the predetermined symbol 800 (of FIG. 8A). Another trigger condition exists when the displayed symbols include a predetermined symbol 800 (of FIG. 8A) and the predetermined symbol 800 lands on the pay line 708 (of FIG. 7C). Still another trigger condition exists when the feature controller 625*b* determines that a feature game is to be awarded and when the displayed symbols include the predetermined symbol 800 (of FIG. 8A). Yet another trigger condition exists when the feature controller 625*b* determines that a feature game is to be awarded, when the displayed symbols include the predetermined symbol 800 (of FIG. 8A), and when the predetermined symbol 800 lands on the pay line 708 (of FIG. 7E). In some embodiments, the trigger detection controller 625*c* communicates with the feature controller 625*b* that when the selected symbols for display include a predetermined symbol 800 (of FIG. 8A), or when the selected symbols for display include a predetermined symbol 800 landing on the pay line 708, such that the feature controller 625*b* may determine whether to award a feature game. In other embodiments, the trigger detection controller 625*c* may be configured to detect any or all of the trigger conditions discussed above.

Further, the processor 62 also includes an award controller 625*d* to communicate with the trigger detection controller 625*c* and to determine whether an award is to be awarded. For example, when the displayed symbols include a winning combination, the award controller 625*d* determines an award, or an amount of a prize, with respect to the winning combination. The award controller 625*d* also determines an award, for example, when the displayed symbols include the predetermined symbol 800 (of FIG. 8A), or when the displayed symbols include a predetermined symbol 800 and when the predetermined symbol 800 lands on the pay line 708. In such cases, when the displayed symbols include a predetermined symbol 800 (of FIG. 8A), or when the displayed predetermined symbol 800 lands on the pay line 708, the award controller 625*d* determines a number of free-spins of the base game 700 to be awarded. The award controller 625*d* also awards a prize for the displayed predetermined symbol 800 landing on the pay line 708 in the base game. In such cases, instead of displaying "PAYLINE" in the pay line text indicator 710, the pay line text indicator 710 displays "WIN," as discussed below. The award controller 625*d* also determines to award winnings associated with the feature game.

In some embodiments, during the animation of the anticipation states 830, the feature controller 625*b* may dynamically determine whether to award a feature game. In other embodiments, the feature controller 625*b* may predetermine whether to award a feature game before the base game 700 (of FIG. 7E) is initiated.

When the feature controller 625*b* determines a feature game is to be awarded, instead of proceeding to the fourth anticipation state 836, the display controller 621 may control the display 54 to animate the predetermined symbol 800 transitioning into a plurality of free-spin states. In some embodiments, an animation of the anticipation states 830 may last as long as credits are being added to the win meter 716 for an award due for the predetermined symbol 800 landing on the pay line 708. For example, an animation of the anticipation states 830 for a 200-credit win takes longer than an animation of the anticipation states 830 for a 2-credit win. In some embodiments, a player may use the game play mechanism 56 to advance the win meter 718 to display a win total, instead of repeatedly animating the plurality of anticipation states 830 while intermediately incrementing the win meter 718.

FIG. 8D illustrates a plurality of free-spin states 850, when the feature controller 625*b* determines to award a number of free-spins. The free-spin states 850 include a first free-spin state 851, similar to the first anticipation state 801 (of FIG. 8A). In the first free-spin state 851, the predetermined symbol 800 includes doors 802, symbol text 804, and siren 806. During the transition, the doors 802 are initially open and sandwich the symbol text 804, and the siren 806 is not lit. The free-spin states 850 also show a second free-spin state 852 (similar to the second anticipation state 832), in which the symbol text 804 ("Lock Zone") begins to separate, the siren 806 lights up, and the glow 833 begins to show between the symbol text 804. In a third free-spin state 853 (similar to the third anticipation state 834), the symbol text 804 remains separated, the siren 806 continues to light, the glow 833 continues to show in between the symbol text 804, and the doors 802 begin to partially close. In a fourth free-spin state 854, the symbol text 804 remains separated, the siren 806 continues to light, but the doors 802 are shut behind the symbol text 804 and the glow 833 is shut behind the doors 802. In a fifth free-spin state 855, the symbol text 804 rejoins, the siren 806 continues to light, and the doors 802 remain shut behind the symbol text 804. Thereafter, a feature game commences, detailed hereinafter.

In short, during play of the base game 700 (of FIG. 7E), when the predetermined symbol 800 lands on a pay line and the feature controller 625*b* determines that a feature game is to be awarded, the display 54 animates the predetermined symbol 800 in the anticipation states 830, and transitions to animate the free-spin states 850. During the animation of the free-spin states 850, the doors 802 open, partially close, and completely close, the symbol text 804 separates and rejoins, the glow 833 appears and disappears, and the siren 806 lights and turns off.

Figure 9A:
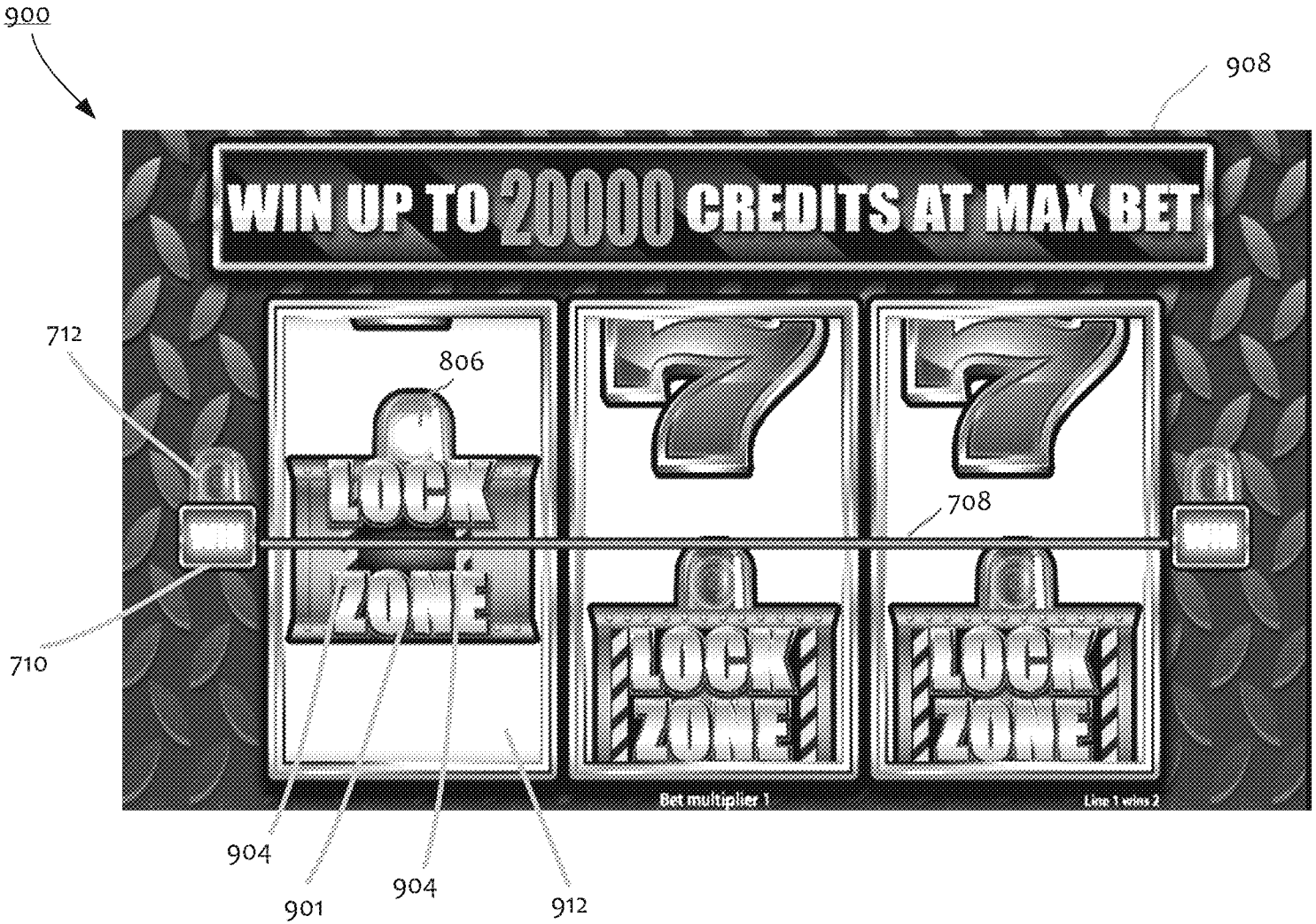
FIG. 9A illustrates an exemplary predetermined symbol in a feature game.

Referring back to FIG. 6, the feature controller 625*b* also manages how a feature game is played. FIG. 9A shows a commencement of a feature game 900 that includes a plurality of free spins of the base game 700 with a predetermined symbol 901 (similar to the predetermined symbol 800 in the third free-spin state 853) on the pay line 708. The display 54 displays the predetermined symbol 901 in the third free-spin state 853 where the predetermined symbol 901 lands on pay line 708. The pay line text indicator 710 displays "WIN" indicative of a feature game having been awarded, and the siren 806 flashes. The display 54 displays a banner 908 having an exemplary message "WIN UP TO 20000 CREDITS AT MAX BET" indicative of the base game is being played. The display 54 also displays an original background 912 indicative of the base game 700 being played. Note that the predetermined symbol 901 is now transitioning from the anticipation states 830 to the free-spin states 850, in which doors 904 are closing, and all other symbols visible that are not on pay line 708 remain unchanged.

Figure 9B:
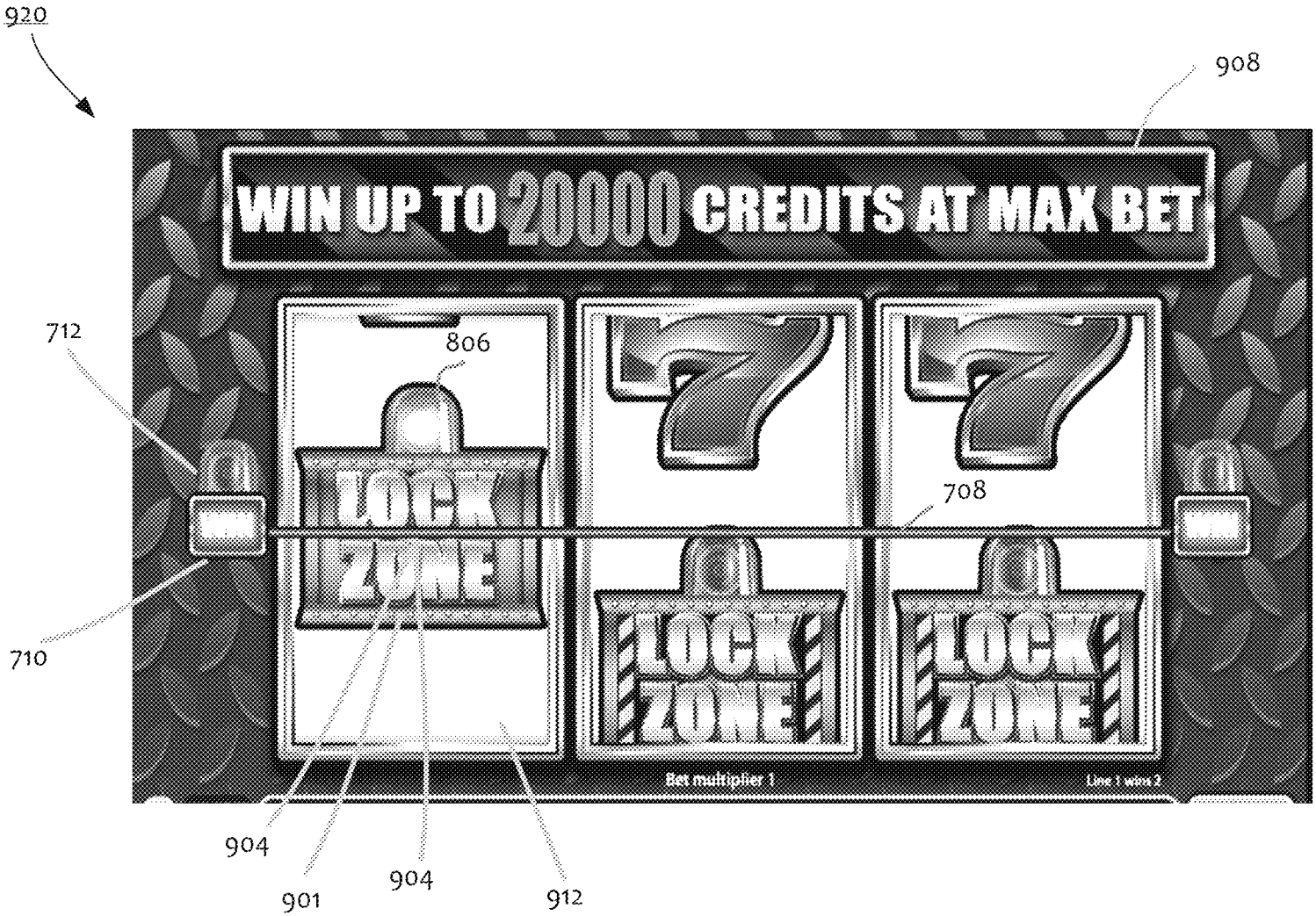
FIG. 9B illustrates the exemplary predetermined symbol of FIG. 9A being pulled away from a pay line.

FIG. 9B shows an animation 920 of the fifth free-spin state 854 that includes a predetermined symbol 901 on the pay line 708. However, the symbol text indicator 708 is not separated and the doors 904 are shut.

Figure 9C:
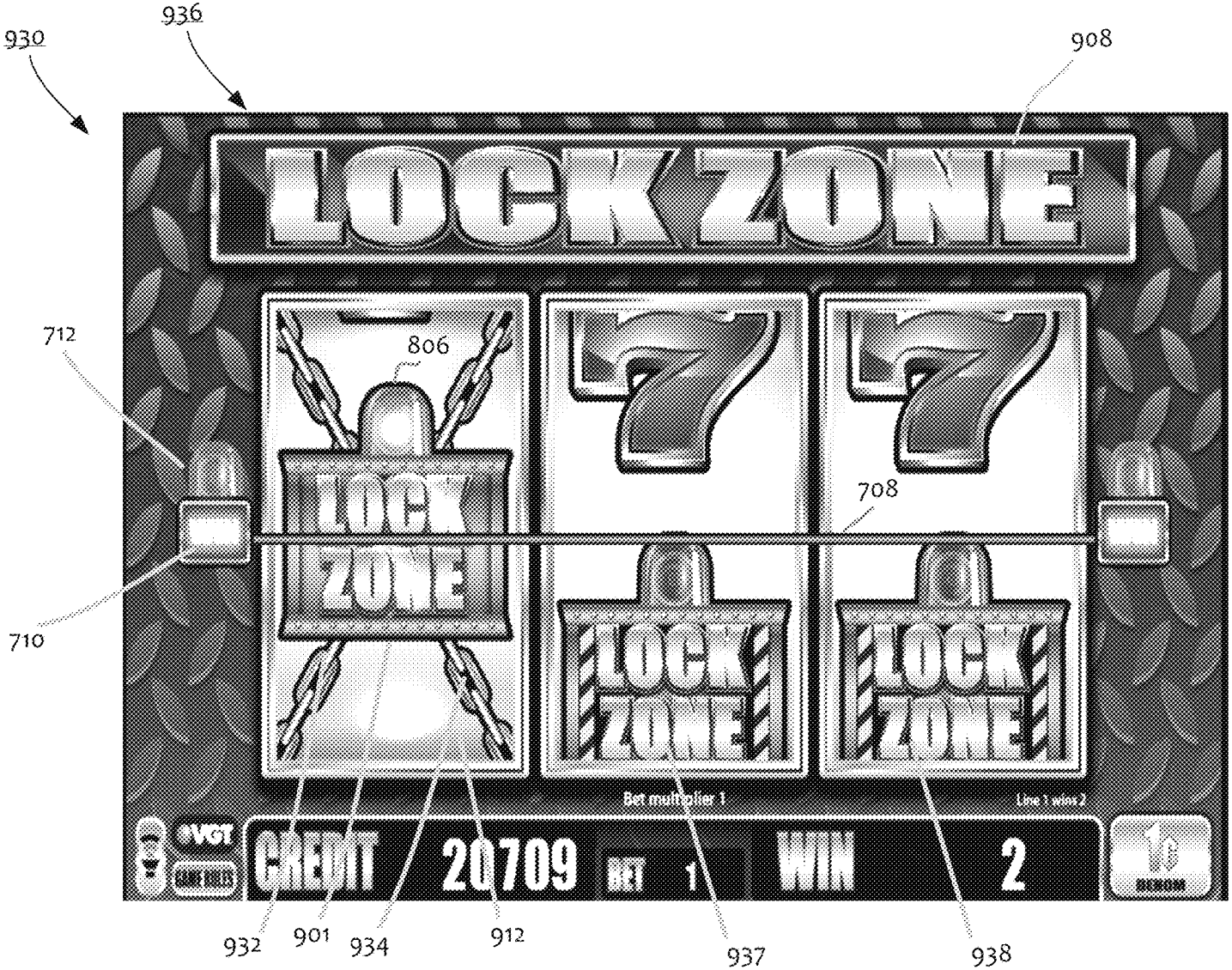
FIG. 9C shows a first animation of a free-spin state.

FIG. 9C shows an animation 930 of the fifth free-spin state 854 that includes a first chain 932 and a second chain 934 in a process of locking the predetermined symbol 901 on the pay line 708. In some embodiments, the first chain 932 locks the predetermined symbol 901 first. In other embodiments, the second chain 934 locks the predetermined symbol 901 first. Still in other embodiments, the first chain 932 and the second chain 934 lock the predetermined symbol 901 simultaneously. The siren 712 also begins to flash, while the background 912 also begins to change color to indicate that a feature game 936 has been initiated. Further, the banner 908 has also been changed to reflect that the feature game 936 has been initiated with "LOCK ZONE." In the embodiment shown, two additional predetermined symbols 937, 938 are displayed, with respective doors opened.

Figure 9D:
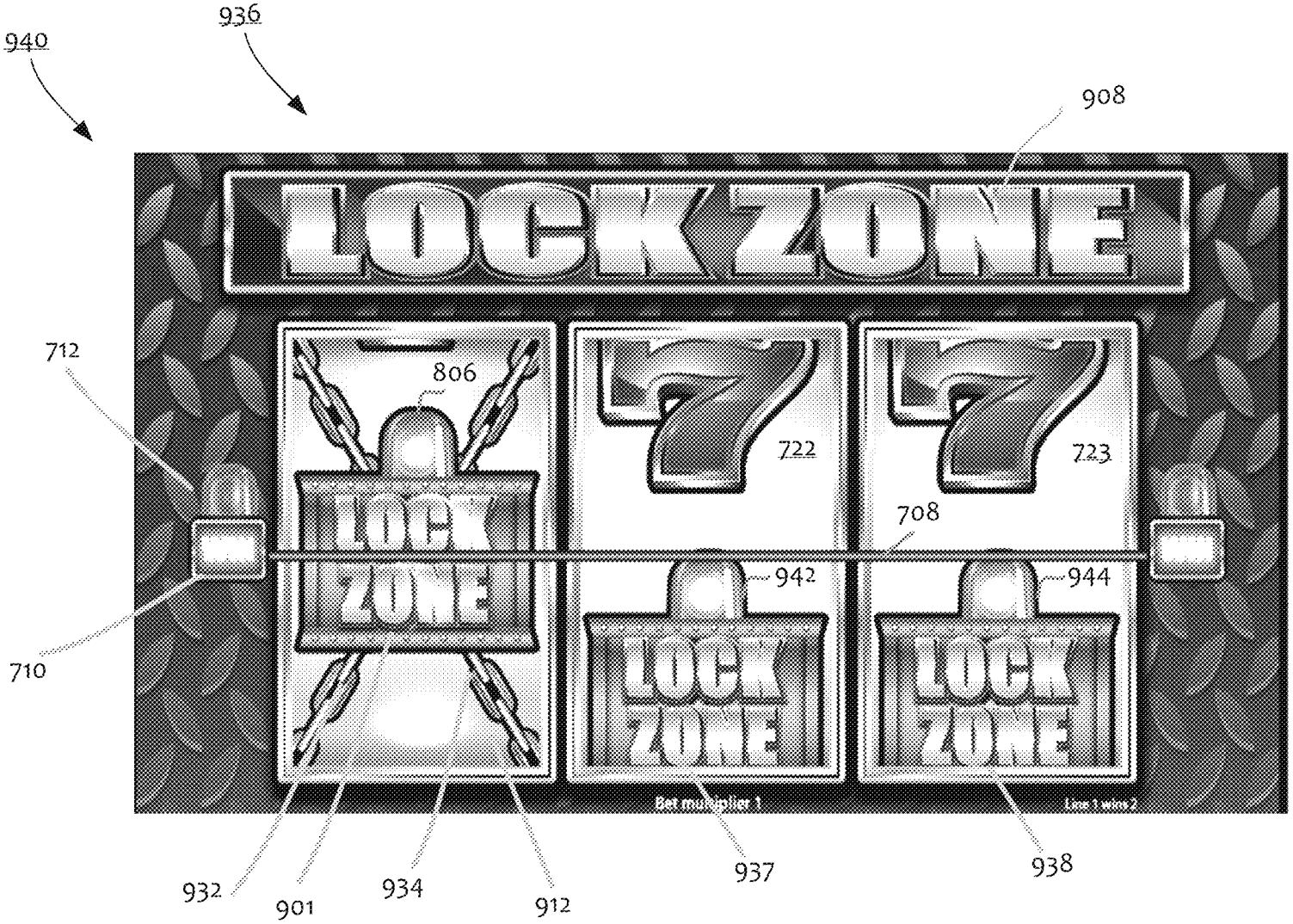
FIG. 9D shows a second animation of a free-spin state.

FIG. 9D shows an animation 940 of the fifth free-spin state 854 of the feature game 936. In the embodiment shown, the doors of the two additional predetermined symbols 937, 938 are now closed behind the "LOCK ZONE" text, and the sirens 942, 944 begin to flash. However, only the predetermined symbol 901 remains locked to the pay line 708, while reels 722, 723 are free to spin.

Figure 9E:
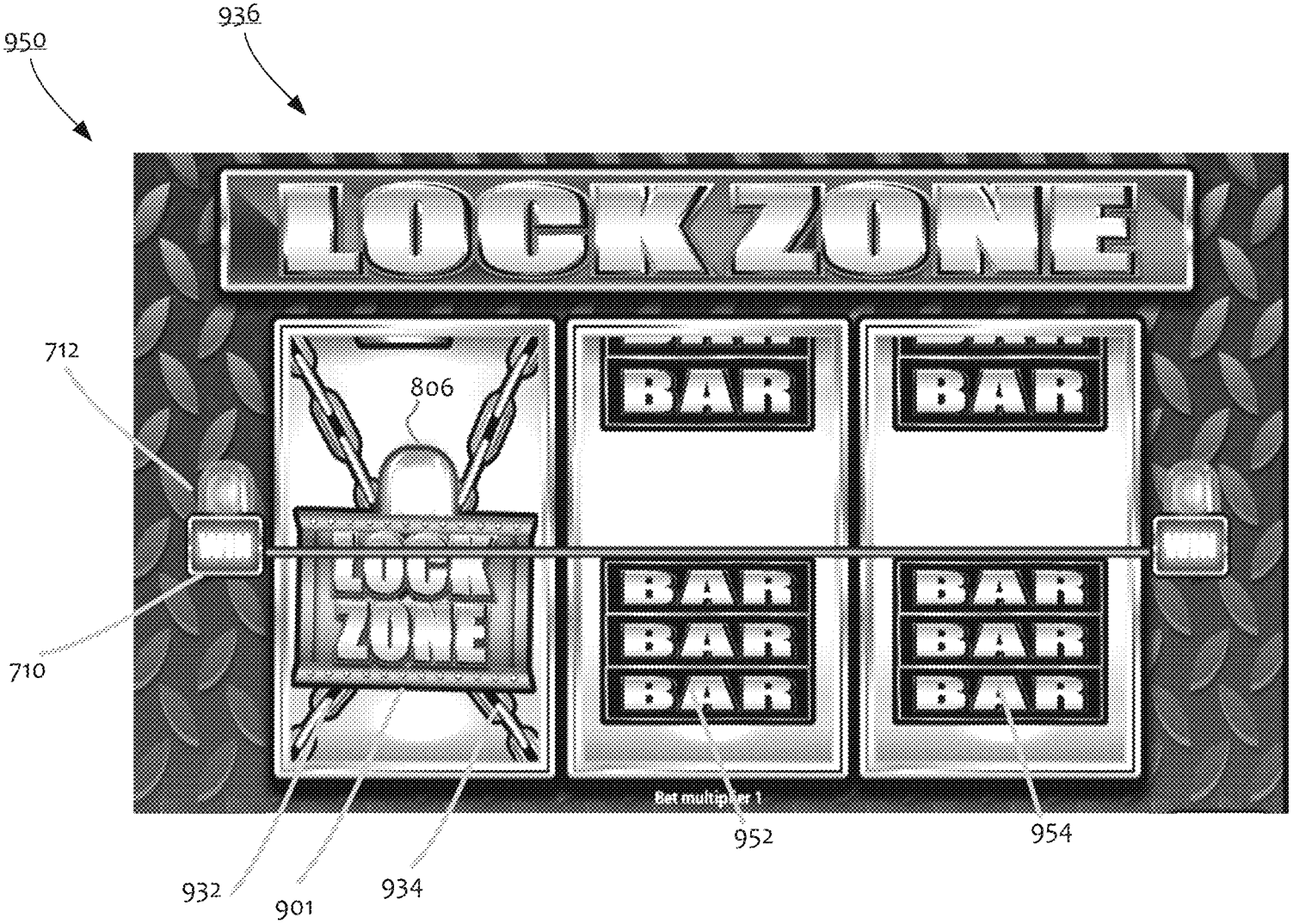
FIG. 9E shows a third animation of a free-spin state.

FIG. 9E shows an animation 950 of the fifth free-spin state 854 of the feature game 936. In the embodiment shown, a first three-bar symbol 952 and a second three-bar symbol 954 are selected for display. In the embodiment shown, the display controller 621 may animate an attempt to remove the chains 932, 934 by tugging the locked predetermined symbol 901 of FIG. 9D down. As shown in FIG. 9E, the animation 950 begins with the locked predetermined symbol 800 of FIG. 9A being tugged down from the pay line 708. The animation 950 then returns the locked predetermined symbol 901 of FIG. 9A snapping back to the pay line 708.

In other embodiments, the feature controller 625*b* commences the feature game 900 when a player initiates the feature game 950 via the game play mechanism 56 (of FIG. 1). When the feature game 900 commences, the feature controller 625*b* also causes the display 54 to spin a plurality of reels for a predetermined amount of time, for example, 1 second. During the commencement, for another predetermined amount of time, for example, 2 seconds, the reels spin, and the siren 806 animates flashing while the background 912 changes color. The reels stop spinning after an amount of time, for example, 2.75 seconds, the free-spin feature game 950 starts. After the feature game is finished, the background 908 returns to its original color, the siren 712 stop flashing, and the banner 908 returns to a base game banner.

As discussed above, the feature game 950 is a plurality of free-spins of the base game 700 with the predetermined symbol 901 padlocked on the pay line 708. In this regard, the award controller 625*d* (of FIG. 6) determines the number of free-spins of the base game 700 to be awarded.

Figure 10:
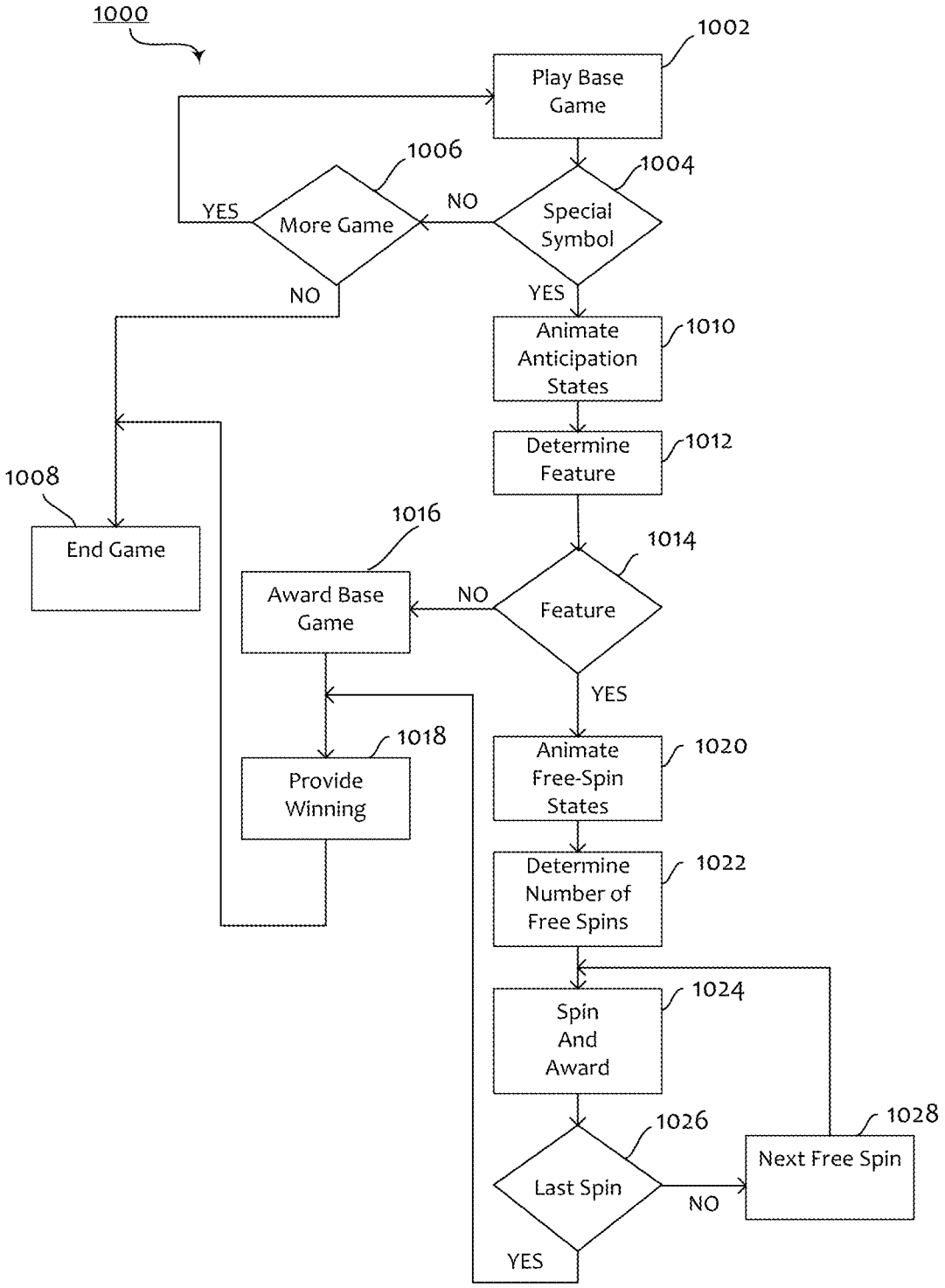
FIG. 10 illustrates a flow chart of an exemplary lock zone game process.

FIG. 10 illustrates a flow chart of an exemplary lock zone game process 1000. At block 1002, the base game 700 (of FIG. 7A) is played from which a feature game may be triggered. In some embodiments, when the credit input mechanism 52.1 (of FIG. 6) receives a physical item representing a monetary value for establishing a credit balance, the game controller 60 (of FIG. 6) may initiate the base game 700. The game controller 60 also selects symbols from the symbol memory module 64.1 for display. For example, the base game 700 may have three vertically spinning reels 721, 722, 723 which stop to display a 1 by 3 array of game symbols. Awards are achieved based on a symbol outcome shown in the 1×3 array.

The trigger detection controller 625*c* may determine at block 1004 if a special symbol (such as, for example, the predetermined symbol 800 of FIG. 8A) is displayed during the play of the base game 700. If the trigger detection controller 625*c* determines at block 1004 that a special symbol is not displayed, or not displayed on the pay line 708, the lock zone game process 1000 at block 1006 determines if another base game is to be played. If no additional base game is to be played, as determined at block 1006, the lock zone game process 1000 ends at block 1008. If an additional base game is to be played, as determined at block 1006, the lock zone game process 1000 returns to block 1002. If the trigger detection controller 625*c* determines at block 1004 that a special symbol is displayed, or displayed on the pay line 708, the trigger detection controller 625*c* determines that a trigger condition exists, and the lock zone game process 1000 proceeds to cause the display controller 621 to animate the plurality of anticipation states 830 at block 1010. At block 1012, the feature controller 625*b* randomly determines if a feature game is to be awarded.

At block 1014, the lock zone game process 1000 determines if a feature game is to be awarded. If the lock zone game process 1000 determines that a feature game is not awarded, the award controller 625*d* increases the credit balance based on the special symbol, or on the special symbol landed on the pay line 708, at block 1016. At block 1018, the pay mechanism 52.1 then provides a payout based on the credit balance.

However, if the lock zone game process 1000 determines that a feature game is to be awarded, the feature controller 625*b* at block 1020 causes the display 54 to animate a transition from the plurality of anticipation states 830 to the plurality of free-spin states 850, as discussed above. The lock zone game process 1000 also determines a number of free spins being awarded, and commences a feature game (similar to the feature game 900 of FIG. 9D) at block 1022. At block 1024, the feature controller 625*b* causes the reels 721, 722, 723 to visually spin, while padlocking any unlocked reels of reels 721, 722, 723 to visually spin, while padlocking the reel with the special symbol so that the padlocked reel does not spin to keep the special symbol locked on the pay line 708. After spinning the unlocked reels of reels 721, 722, 723, the award controller 625*d* awards a winning, and increases the credit balance based on the winning. In some embodiments, the winning for a subsequent spin is at least equal to the winning for a previous spin. For example, if the winning for a current spin awards 6 credits, the winning for a subsequent spin awards at least 6 credits. For example, if the winning for a current spin will award 6 credits, the winning for a subsequent spin awards at least 6 credits for a total feature game award of 12 credits. Thus, the feature game 900 guarantees a winning in each spin, and increases a total winning as each additional spin is awarded.

Table I below lists an exemplary pay table for the feature game 900 based on wagers placed. For example, when the special symbol is a wild symbol, and when a wager of 2 credits is placed, a combination of 1 wild and a Red 7 pays a 1 Wild win (2× bet), which is 4 credits.

TABLE I

| Pay | 1 Credit | 2 Credits | 3 Credits |
|---|---|---|---|
| 3 Wild | 500 | 1000 | 2500 |
| 3 Red 7 | 100 | 200 | 300 |
| 3 Bar | 50 | 100 | 150 |
| 3 Bar | 20 | 40 | 60 |
| 3 Bar | 10 | 20 | 30 |
| 3 Any Bar | 5 | 10 | 15 |
| 2 Wild | 5 | 10 | 15 |
| 1 Wild | 2 | 4 | 6 |

Referring back to FIG. 10, at block 1026, the lock zone game process 1000 determines if the spin at block 1024 is the last spin. If the spin at block 1024 is the last spin, the pay mechanism 52.1 then provides a payout based on the credit balance at block 1018. If the spin at block 1024 is the last spin, the lock zone game process 1000 moves to a next spin at block 1028 and repeats block 1024. If an additional special symbol is displayed on the display 54, the displayed additional special symbol is also padlocked with chains 904. Further, U.S. application Ser. Nos. 29/608103 and 29/608104, are incorporated herein by reference.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art will appreciate that program code provides a series of instructions executable by the processor.

It will be understood to persons skilled in the art of the invention that many modifications may be made without departing from the spirit and scope of the invention. In particular, it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed is:

1. A gaming machine, comprising:

a display; and a game controller executing instructions stored in a memory, wherein execution of the instructions causes the game controller to at least:

present, via the display, a base game outcome for a play of a base game, wherein the base game outcome comprises symbols presented at a plurality of display positions;

present a base game award on the display if the base game outcome is a winning outcome; and in response to the base game outcome comprising an instance of a first predetermined symbol:

present the instance of the first predetermined symbol transitioning on the display through a plurality of anticipation states toward an instance of a second predetermined symbol that is different than the first predetermined symbol;

in response to determining not to award a play of a feature game, present the instance of the first predetermined symbol further transitioning on display from the plurality of anticipation states back to the instance of the first predetermined symbol; and in response to determining to award the play of the feature game:

present the instance of the first predetermined symbol further transitioning on the display from the plurality of anticipation states to the instance of the second predetermined symbol; and after transitioning to the instance of the second predetermined symbol, initiate the play of the feature game with the instance of the first predetermined symbol replaced with the instance of the second predetermined symbol.

2. The gaming machine of claim 1, wherein execution of the instructions further causes the game controller to increase a credit balance based on base game award associated with the base game outcome.

3. The gaming machine of claim 1, wherein execution of the instructions further causes the game controller to make a determination as to whether to award the play of the feature game prior to presenting the base game outcome.

4. The gaming machine of claim 1, wherein execution of the instructions further causes the game controller to make a determination as to whether to award the feature game based, at least in part, on the base game outcome including the instance of the first predetermined symbol.

5. The gaming machine of claim 1, wherein execution of the instructions further causes the game controller:

allocate a plurality of spins of a plurality of reels to the play of the feature game prior to initiating the play of the feature game; and present, for each spin of the plurality of spins, a feature game outcome at the plurality of display positions.

6. The gaming machine of claim 5, wherein execution of the instructions further causes the game controller, for each of spin of the plurality of spins, to:

hold a reel of the plurality of reels with the instance of the second predetermined symbol; and spin each reel of the plurality of reels without the instance of the second predetermined symbol.

7. The gaming machine of claim 5, wherein execution of the instructions further causes the game controller to award a credit amount for each spin of the plurality of spins.

8. The gaming machine of claim 5, wherein execution of the instructions further causes the game controller to award a credit amount for each spin of the plurality of spins that is at least equal to a credit amount awarded to a previous spin of the plurality of spins.

9. The gaming machine of claim 5, wherein execution of the instructions further causes the game controller to cause the display to present one or more graphical elements that visually convey that the instance of the second predetermined symbol is locked to its respective display position.

10. The gaming machine of claim 1, further comprising:

a credit input mechanism; and a payout mechanism;

wherein execution of the instructions further causes the game controller to:

in response to the credit input mechanism receiving a physical item representing a credit value, establish, based on the credit value, a credit balance that is increasable and decreasable based on wagering activity; and dispense, via the payout mechanism, credit from the credit balance.

11. The gaming machine of claim 1, wherein execution of the instructions further causes the game controller, in response to determining to award the play of the feature game, to replace each instance of the first predetermined symbol with a corresponding instance of the second predetermined symbol.

12. A method of gaming with a gaming machine, the method comprising:

determining that a feature game is to be awarded;

spinning a plurality of reels of the gaming machine to present, for a base game, a base game outcome at a plurality of display positions of a display;

presenting, via the display, a first predetermined symbol of the base game outcome transitioning through a plurality of anticipation states; and in response to the feature game being awarded:

presenting, via the display, the first predetermined symbol of the base game outcome further transitioning from the plurality of anticipation states to a second predetermined symbol that is different than the first predetermined symbol;

graphically depicting the reel with the second predetermined symbol as a locked reel and reels of the plurality of reels without the second predetermined symbol as unlocked reels; and spinning each of the unlocked reels while holding the locked reel in place to present a feature game outcome at the plurality of display positions, the feature game outcome comprising the second predetermined symbol of the locked reel.

13. The method of claim 12, further comprising, in response to the feature game not being awarded:

presenting, via the display, the first predetermined symbol further transitioning from the plurality of anticipation states back to the first predetermined symbol; and permitting the reel presenting the first predetermined symbol to spin during a subsequent spin of the base game.

14. The method of claim 12, increasing a credit balance based on an award associated with the base game outcome.

15. The method of claim 12, wherein said determining that the feature game is to be awarded is independent of the base game outcome.

16. The method of claim 12, wherein determining that the feature game is to be awarded is based, at least in part, on the base game outcome including the first predetermined symbol.

17. The method of claim 12, further comprising awarding the feature game with a plurality of spins of the plurality of reels.

18. The method of claim 17, further comprising awarding a credit amount for each spin of the plurality of spins.

19. The method of claim 17, further comprising awarding a credit amount for each spin of the plurality of spins that is at least equal to a credit amount awarded to a previous spin of the plurality of spins.

20. The method of claim 12, further comprising:

establishing a credit balance that is increasable and decreasable based on wagering activity in response to a credit input mechanism of the gaming machine receiving a physical item representing a credit value; and dispensing credits from the credit balance via a payout mechanism of the gaming machine.

* * * * *